US010928770B2

(12) United States Patent
Abe

(10) Patent No.: US 10,928,770 B2
(45) Date of Patent: Feb. 23, 2021

(54) IMAGE FORMING APPARATUS

(71) Applicant: BROTHER KOGYO KABUSHIKI KAISHA, Nagoya (JP)

(72) Inventor: Koji Abe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/359,057

(22) Filed: Mar. 20, 2019

(65) Prior Publication Data

US 2019/0302688 A1 Oct. 3, 2019

(30) Foreign Application Priority Data

Mar. 29, 2018 (JP) ..... JP2018-063863

(51) Int. Cl.

*G03G 21/18* (2006.01)
*G03G 21/16* (2006.01)
*G03G 15/08* (2006.01)

(52) U.S. Cl.

CPC ..... *G03G 21/1864* (2013.01); *G03G 15/0865* (2013.01); *G03G 21/1633* (2013.01); *G03G 21/1647* (2013.01); *G03G 2221/1654* (2013.01); *G03G 2221/1869* (2013.01)

(58) Field of Classification Search

CPC ..... G03G 21/1817; G03G 21/1842; G03G 21/1857; G03G 21/1864

See application file for complete search history.

(56) References Cited

U.S. PATENT DOCUMENTS

| | | | | |
|---|---|---|---|---|
| 9,098,061 | B2 * | 8/2015 | Tamaru | G03G 15/0121 |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0133850 | A1 | 6/2006 | Nishimura | |
| 2016/0041519 | A1 | 2/2016 | Sato | |

FOREIGN PATENT DOCUMENTS

| | | | |
|---|---|---|---|
| JP | 2006-106020 | A | 4/2006 |
| JP | 2006-184502 | A | 7/2006 |
| JP | 2016-038512 | A | 3/2016 |

* cited by examiner

*Primary Examiner* — Erika J Villaluna
(74) *Attorney, Agent, or Firm* — Merchant & Gould P.C.

(57) ABSTRACT

An image forming apparatus includes: a top cover configured to cover a part of an opening of a housing; a front cover configured to cover a part of the remaining of the opening; a toner cartridge; and a drum cartridge, wherein in a state where the front cover is located at the opened position, the drum cartridge having the toner cartridge mounted thereto is mountable and demountable to and from the housing, whereas the drum cartridge is prevented from being mounted and demounted to and from the housing in a state where the front cover is located at the closed position, wherein when the top cover is located at the opened position, the toner cartridge is mountable and demountable to and from the drum cartridge, and wherein when the top cover is located at the closed position, the toner cartridge is prevented from being demounted from the drum cartridge.

19 Claims, 25 Drawing Sheets

IMAGE FORMING APPARATUS

CROSS-REFERENCE TO RELATED APPLICATION

This application claims priorities from Japanese Patent Application No. 2018-063863 filed on Mar. 29, 2018, the entire subject matters of which is incorporated herein by reference.

TECHNICAL FIELD

The present disclosure relates to an image forming apparatus including a drum cartridge.

BACKGROUND

In the related art, an image forming apparatus having a drum cartridge detachably mounted has been known in which a toner cartridge can be further detachably mounted to the drum cartridge and the drum cartridge and the toner cartridge can be individually replaced. When replacing only the toner cartridge, the drum cartridge is demounted from the image forming apparatus and the toner cartridge is then demounted from the drum cartridge.

However, even when a user intends to replace only the toner cartridge, the user should demount the entire drum cartridge having the toner cartridge mounted thereto from the image forming apparatus.

SUMMARY

The present disclosure has been made in view of the above circumstances, and one of objects of the present disclosure is to provide an image forming apparatus from which a toner cartridge and a drum cartridge can be easily replaced.

According to an illustrative embodiment of the present disclosure, there is provided an image forming apparatus including: a housing having an opening; a top cover configured to cover a part of the opening and movable between a closed position at which a part of the opening is covered and an opened position at which a part of the opening is opened; a front cover configured to cover a part of the remaining of the opening and movable between a closed position at which a part of the remaining of the opening is covered and an opened position at which a part of the remaining of the opening is opened; a toner cartridge having a case configured to accommodate therein toner, and a drum cartridge including a photosensitive drum and receives the toner cartridge to be mountable thereto. In a state where the front cover is located at the opened position, the drum cartridge having the toner cartridge mounted thereto is mountable and demountable to and from the housing through at least a part of the remaining of the opening. In a state where the front cover is located at the closed position, the drum cartridge having the toner cartridge mounted thereto is prevented from being mounted and demounted to and from the housing through a part of the opening or a part of the remaining of the opening. In a state where the top cover is located at the opened position, the toner cartridge is mountable and demountable to and from the drum cartridge through a part of the opening, in a state where the drum cartridge is mounted to the housing. In a state where the top cover is located at the closed position, the toner cartridge is prevented from being demounted from the drum cartridge through a part of the opening, in the state where the drum cartridge is mounted to the housing.

DETAILED DESCRIPTION

Hereinafter, an illustrative embodiment of the present disclosure will be described in detail with reference to the drawings.

Figure 1:
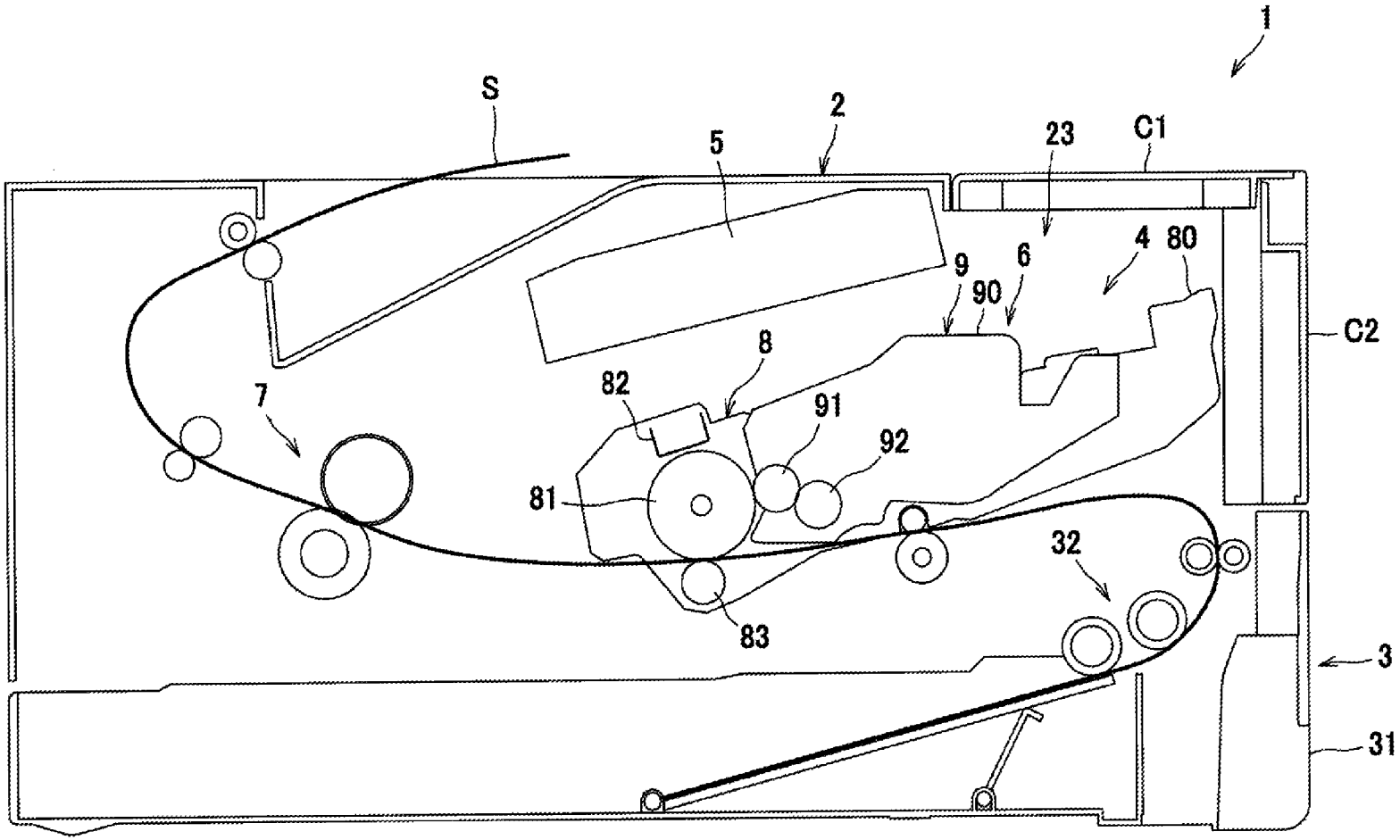
FIG. 1 illustrates a schematic configuration of an image forming apparatus in accordance with an illustrative embodiment of the present disclosure.

As shown in FIG. 1, an image forming apparatus 1, which is a monochrome laser printer, mainly includes a housing 2, a feeder unit 3 for feeding a recording sheet S into the housing 2, an image forming unit 4 for forming an image on the recording sheet S, a top cover C1, and a front cover C2. The feeder unit 3 is configured to feed the recording sheet S into the housing 2. The image forming unit 4 is configured to form an image on the recording sheet S.

Figure 4:
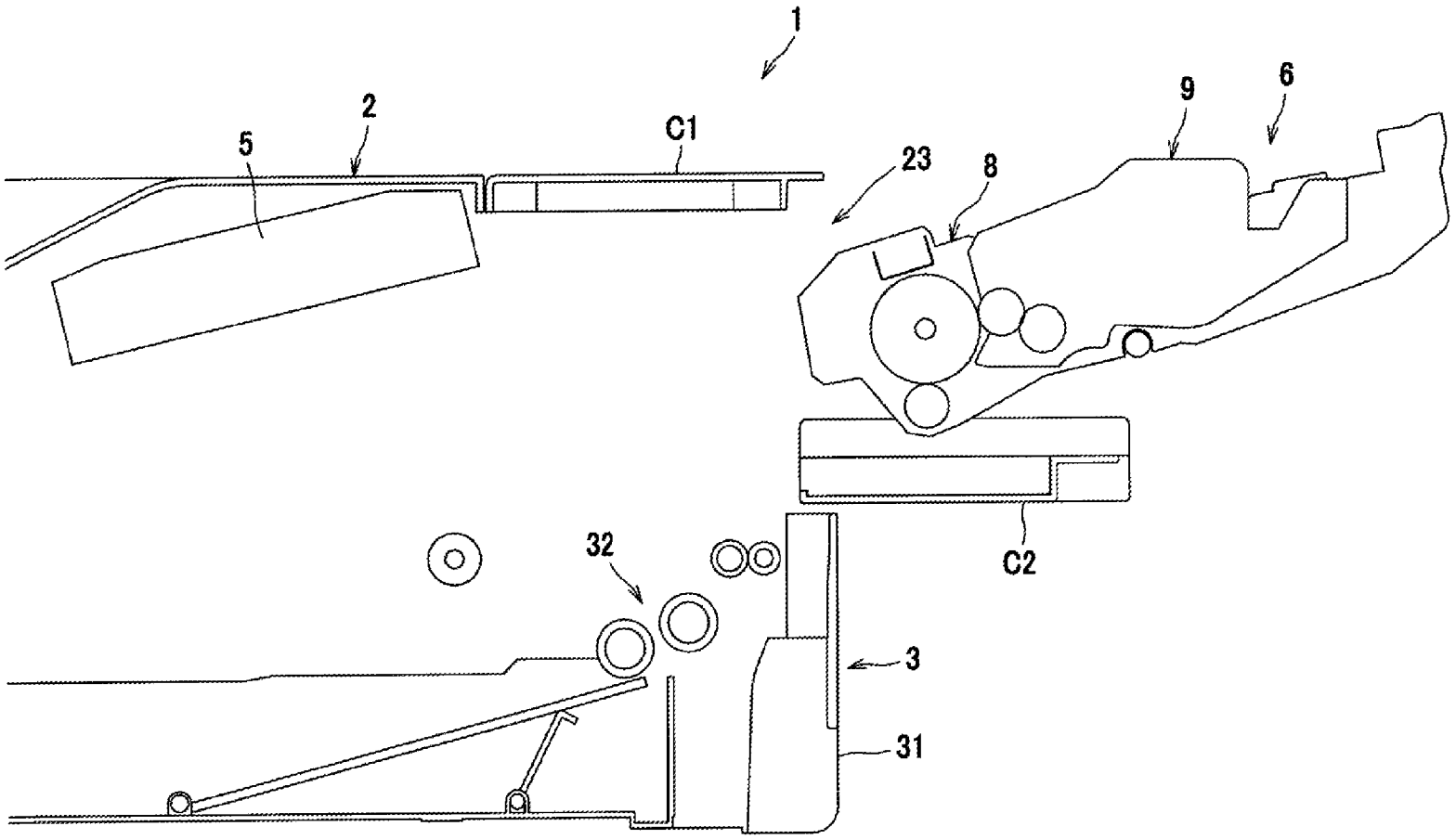
FIG. 4 illustrates an aspect where a drum cartridge is mounted and demounted with only the front cover being opened.
Figure 5:
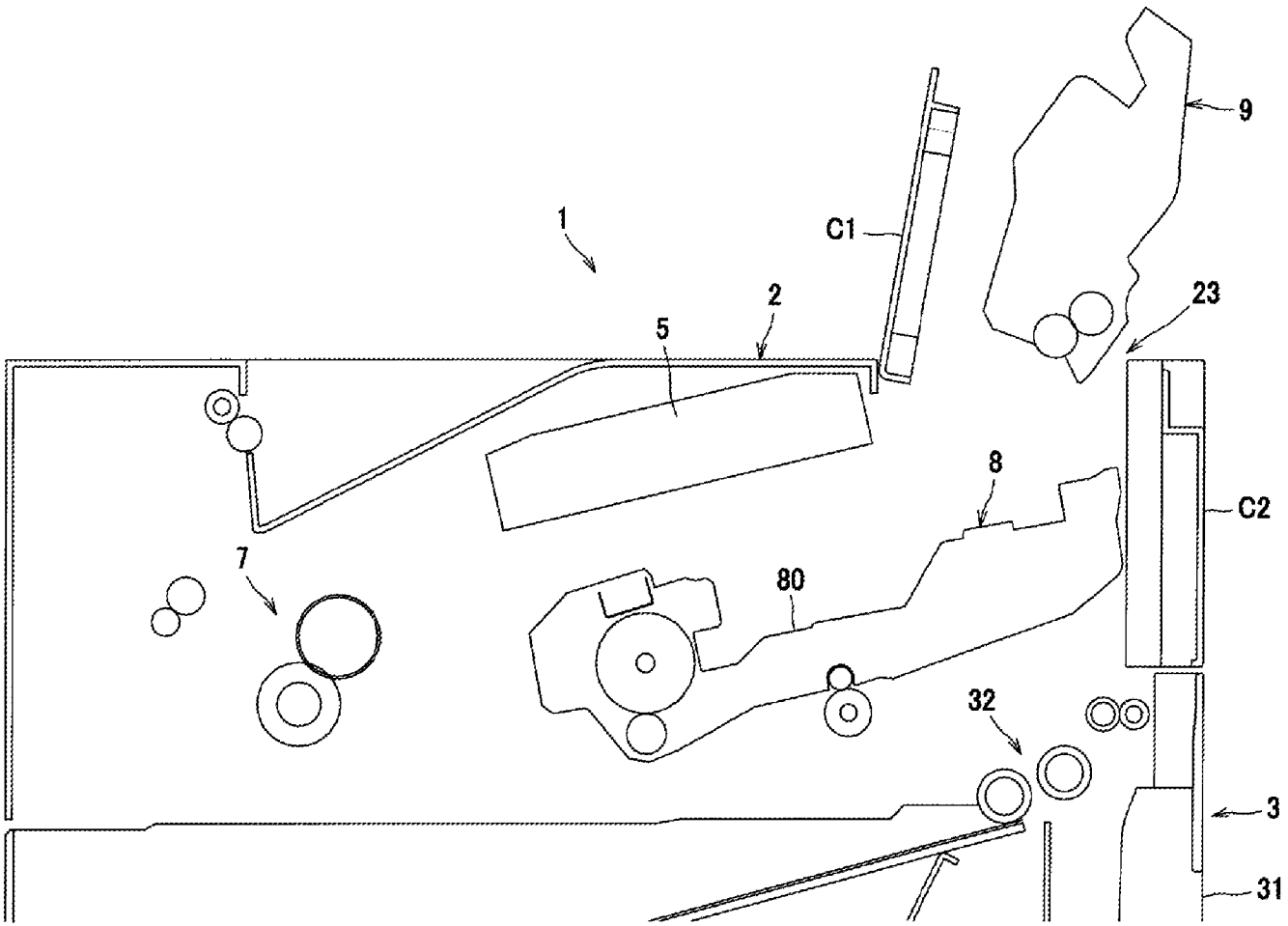
FIG. 5 illustrates an aspect where a toner cartridge is mounted and demounted with only the top cover being opened.

The housing 2 is a hollow case. The housing 2 has an opening 23 (refer to FIGS. 4 and 5). The opening 23 is arranged at a front surface of the housing 2 and an upper surface of the housing 2.

The top cover C1 is arranged at the upper surface of the image forming apparatus 1. The front cover C2 is arranged at the front surface of the image forming apparatus 1.

The top cover C1 is configured to cover a part of the opening 23. The top cover C1 is rotatably supported to the housing 2. The top cover C1 is movable between a closed position (a position shown in FIG. 1) at which a part of the opening 23 is covered and an opened position (a position shown in FIG. 5) at which a part of the opening 23 is opened.

The front cover C2 is configured to cover a part of the remaining of the opening 23. The front cover C2 is rotatably supported to the housing 2. The front cover C2 is movable between a closed position (a position shown in FIG. 1) at which a part of the remaining of the opening 23 is covered and an opened position (a position shown in FIG. 4) at which a part of the remaining of the opening 23 is opened.

The feeder unit 3 includes a feeder tray 31 and a feeder mechanism 32. The feeder tray 31 is detachably mounted to a lower part of the housing 2. The feeder mechanism 32 is configured to feed the recording sheet S in the feeder tray 31 toward the image forming unit 4.

The image forming unit 4 includes a scanner unit 5, a process cartridge 6, and a fixing device 7.

The scanner unit 5 is provided at an upper part in the housing 2. The scanner unit 5 includes a laser light-emitting unit, a polygon mirror, a lens, a reflector and the like, which are not shown. With the scanner unit 5, a laser beam is scanned at high speed on a surface of a photosensitive drum 81, which will be described later.

The process cartridge 6 is mounted between the feeder unit 3 and the scanner unit 5. The process cartridge 6 includes a drum cartridge 8 and a toner cartridge 9. The toner cartridge 9 can be mounted and demounted to and from the drum cartridge 8. The drum cartridge 8 can be mounted and demounted with the toner cartridge 9 being mounted thereto with respect to the housing 2. That is, the process cartridge 6 can be mounted and demounted to and from the housing 2.

The drum cartridge 8 mainly includes a drum frame 80, a photosensitive drum 81, a charger 82 and a transfer roller 83. The toner cartridge 9 can be detachably mounted to the drum frame 80.

The toner cartridge 9 mainly includes a case 90, a developing roller 91 and a supply roller 92. The case 90 can accommodate therein toner.

In the process cartridge 6, a surface of the photosensitive drum 81 being rotating is uniformly charged by the charger 82 and is then exposed by the high-speed scanning of the laser beam emitted from the scanner unit 5. Thereby, a potential of the exposed part is lowered, so that an electrostatic latent image based on image data is formed on the surface of the photosensitive drum 81.

Then, the developing roller 91 rotates, so that the toner in the toner cartridge 9 is supplied to the electrostatic latent image on the photosensitive drum 81 and a toner image is thus formed on the surface of the photosensitive drum 81. Thereafter, the recording sheet S is conveyed between the photosensitive drum 81 and the transfer roller 83, so that the toner image carried on the surface of the photosensitive drum 81 is transferred to the recording sheet S.

The fixing device 7 includes a heating roller 71 and a pressing roller 72. In the fixing device 7 configured in this way, the toner transferred to the recording sheet S is heat-fixed while the recording sheet S passes between the heating roller 71 and the pressing roller 72. In the meantime, the recording sheet S heat-fixed by the fixing device 7 is discharged to an outside of the housing 2.

Figure 2A:
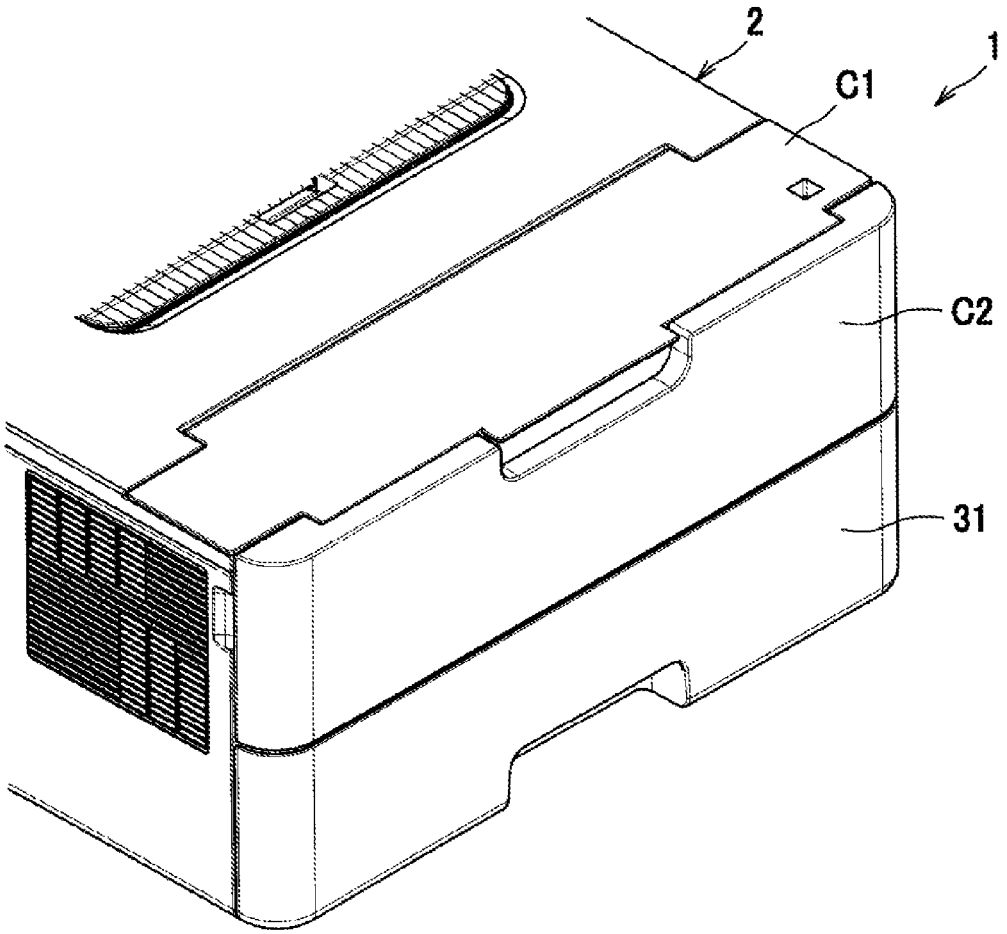
FIG. 2A is a perspective view illustrating a state where a top cover and a front cover are closed.
Figure 2B:
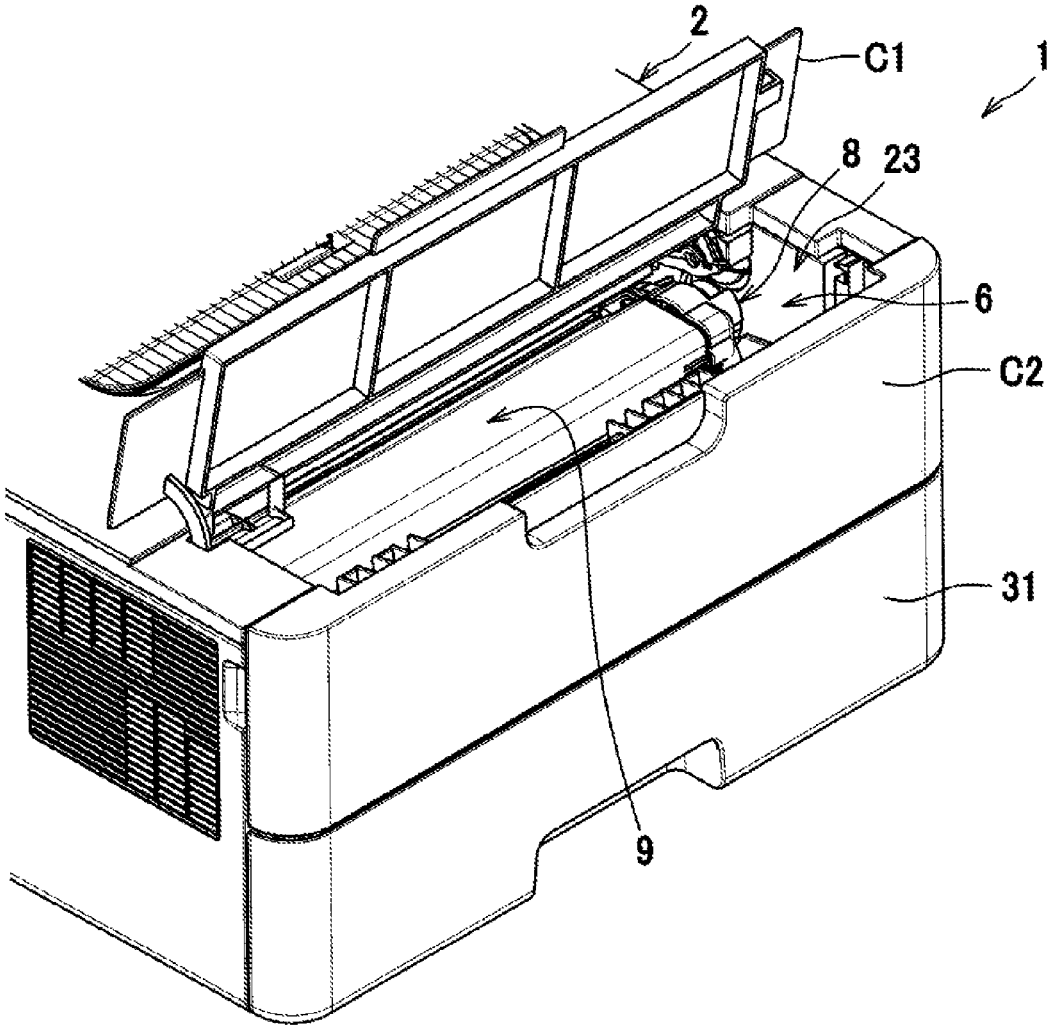
FIG. 2B is a perspective view illustrating a state where only the top cover is opened.

As shown in FIGS. 2A and 2B, when the top cover C1 rotates from the closed position to the opened position in a state where the process cartridge 6 is mounted to the housing 2, the toner cartridge 9 can be visually recognized through a part of the opening 23. For this reason, when the process cartridge 6 is mounted to the housing 2 and the top cover C1 is located at the opened position, the toner cartridge 9 can be demounted from the drum cartridge 8 through a part of the opening 23 (refer to FIG. 5). Also, when the process cartridge 6 is mounted to the housing 2 and the top cover C1 is located at the closed position, the toner cartridge 9 cannot be demounted from the drum cartridge 8 through a part of the opening 23.

Figure 3A:
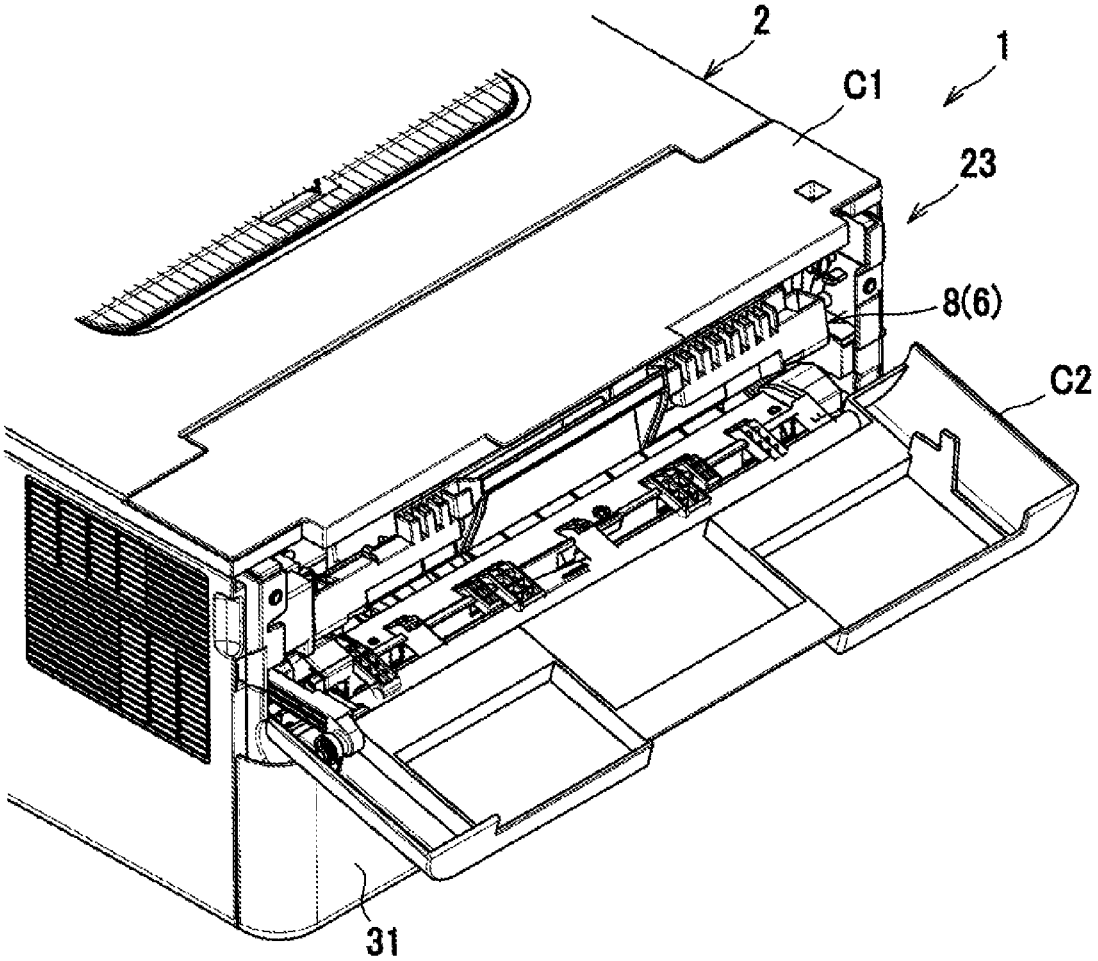
FIG. 3A is a perspective view illustrating a state where only the front cover is opened.

As shown in FIG. 3A, when the process cartridge 6 is mounted to the housing 2 and the front cover C2 is located at the opened position, the drum cartridge 8 can be visually recognized through a part of the remaining of the opening 23. For this reason, when the front cover C2 is located at the opened position, the process cartridge 6 (the drum cartridge 8 having the toner cartridge 9 mounted thereto) can be mounted and demounted to and from the housing 2 through at least a part of the remaining of the opening 23.

Figure 3B:
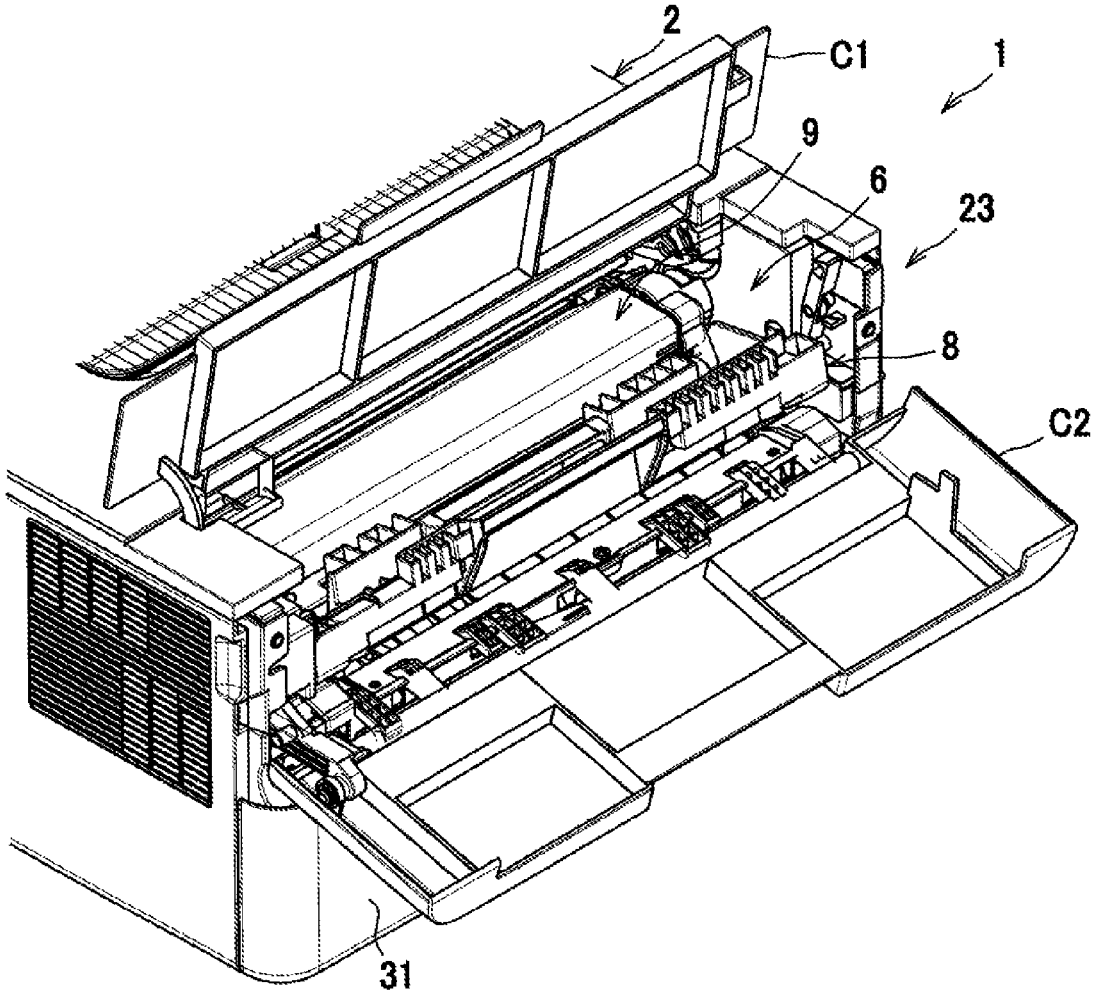
FIG. 3B is a perspective view illustrating a state where both the top cover and the front cover are opened.

Specifically, as shown in FIG. 3A, when the front cover C2 is located at the opened position and the top cover C1 is located at the closed position, the process cartridge 6 can be mounted and demounted to and from the housing 2 through a part of the remaining of the opening 23 (refer to FIG. 4A). As shown in FIG. 3B, when the front cover C2 is located at the opened position and the top cover C1 is located at the opened position, the process cartridge 6 can be mounted and demounted to and from the housing 2 through the opening 23.

Also, as shown in FIGS. 2A and 2B, when the front cover C2 is located at the closed position, the process cartridge 6 cannot be mounted and demounted to and from the housing 2 through a part of the remaining of the opening 23.

Figure 6:
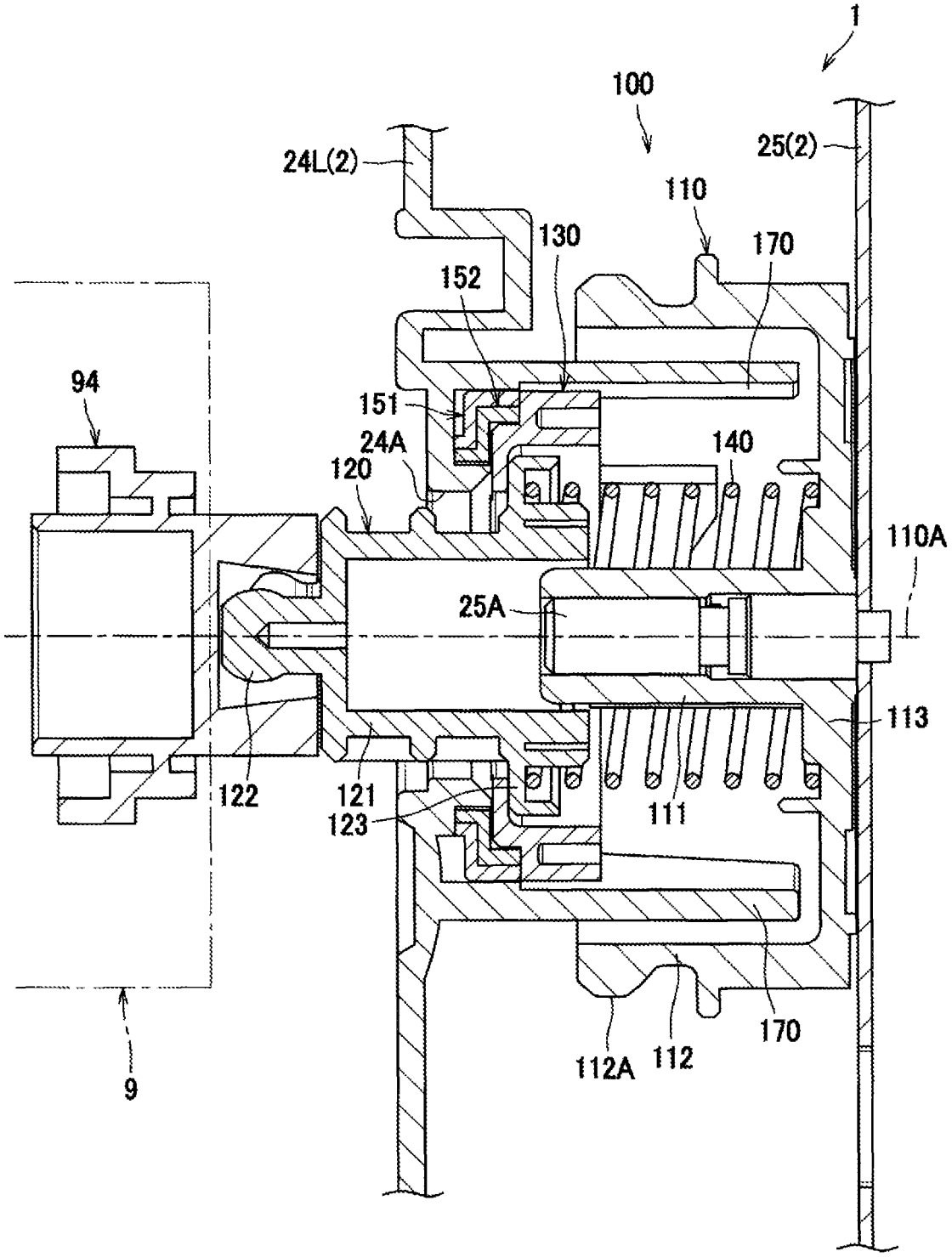
FIG. 6 is a sectional view illustrating a state where a second coupling is located at an engagement position.

As shown in FIG. 6, the toner cartridge 9 has a first coupling 94. The image forming apparatus 1 includes a drive transmission mechanism 100. The first coupling 94 is configured to receive a drive force of driving the developing roller 91 from the drive transmission mechanism 100.

The drive transmission mechanism 100 includes a gear 110, a second coupling 120, a cam contact member 130, an urging member 140, and a restraint surface 170. The housing 2 includes a plate 25 and a frame 24L. The plate 25 has a shaft part 25A. The frame 24L has the restraint surface 170. The gear 110 and the second coupling 120 are rotatable about a rotation axis 110A.

The gear 110 is rotatably supported to the shaft part 25A. The gear 110 mainly has an inner cylinder part 111, an outer cylinder part 112, and a sidewall part 113. An outer peripheral surface of the outer cylinder part 112 is formed with gear teeth 112A. The gear teeth 112A are input with a drive force from a drive source such as a motor provided in the housing 2.

The second coupling 120 mainly has a joint main body 121, an engagement part 122, and a flange part 123. The joint main body 121 has a cylindrical shape. The joint main body 121 engages with the inner cylinder part 111 in a rotating direction. Thereby, rotation of the gear 110 is transmitted to the second coupling 120. The engagement part 122 engages with the first coupling 94.

The second coupling 120 is moveably supported to the inner cylinder part 111.

Figure 8:
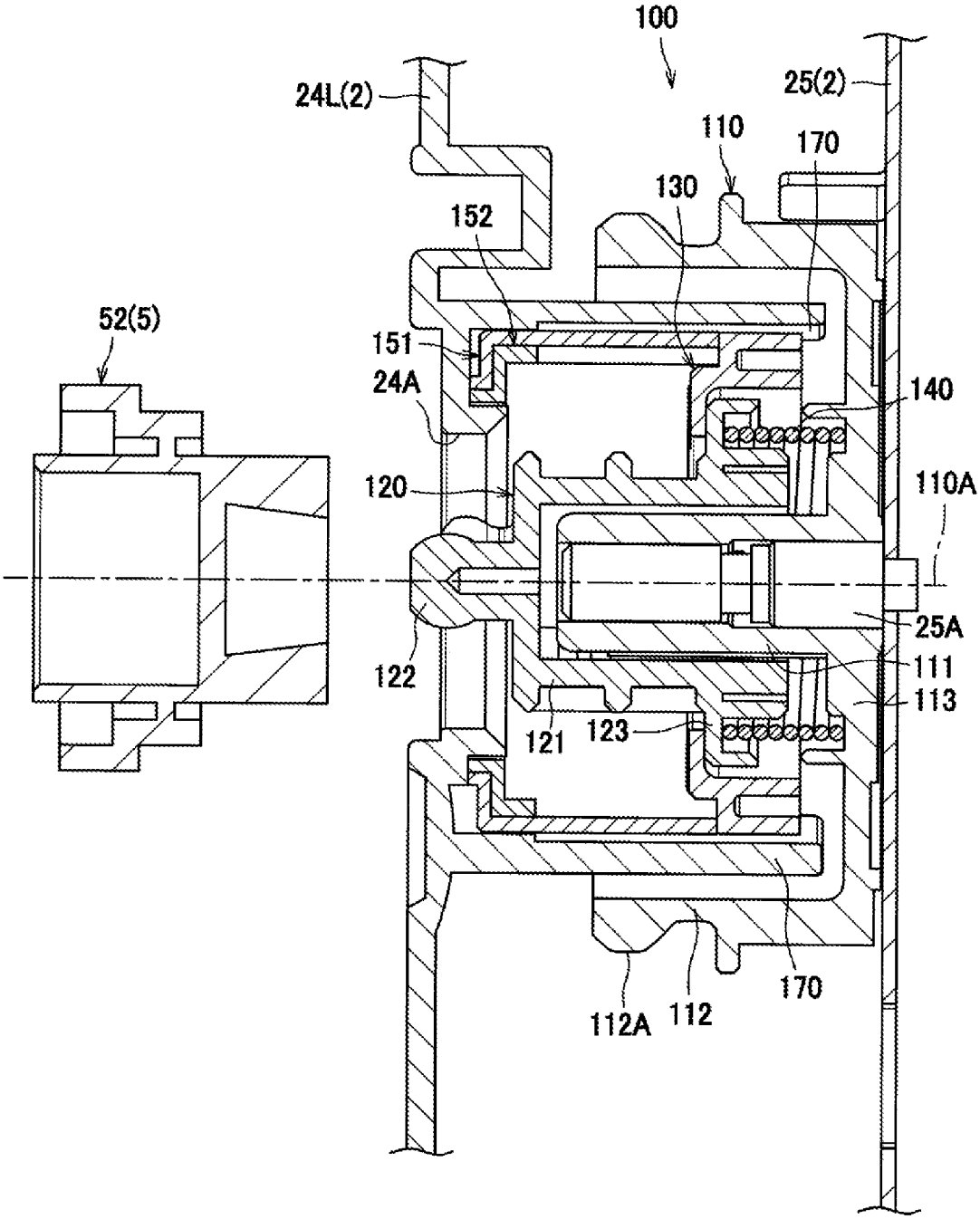
FIG. 8 is a sectional view illustrating a state where the second coupling moves to a non-engagement position by the first cam.

Specifically, the second coupling 120 is configured to be movable between an engagement position (a position shown in FIG. 6) at which it engages with the first coupling 94 and can drive the first coupling 94 and a non-engagement position (a position shown in FIG. 8) at which the engagement with the first coupling 94 is released.

The urging member 140 is a compression coil spring. The urging member 140 is configured to urge the second coupling 120 toward the engagement position. In other words, the urging member 140 is movable the second coupling 120 from the non-engagement position toward the engagement position. In the meantime, in the illustrative embodiment, the drive transmission mechanism 100 is an example of the third movement mechanism.

The cam contact member 130 is configured to move together with the second coupling 120. The cam contact member 130 is supported to be movable between the non-engagement position and the engagement position and is restrained from moving about the rotation axis 110A by the restraint surface 170.

The cam contact member 130 is contacts with a first cam 151 or a second cam 152, which will be described in detail. The first cam 151 or the second cam 152 is configured to press the second coupling 120 via the cam contact member 130. Thereby, the second coupling 120 moves from the engagement position to the non-engagement position.

Figure 7:
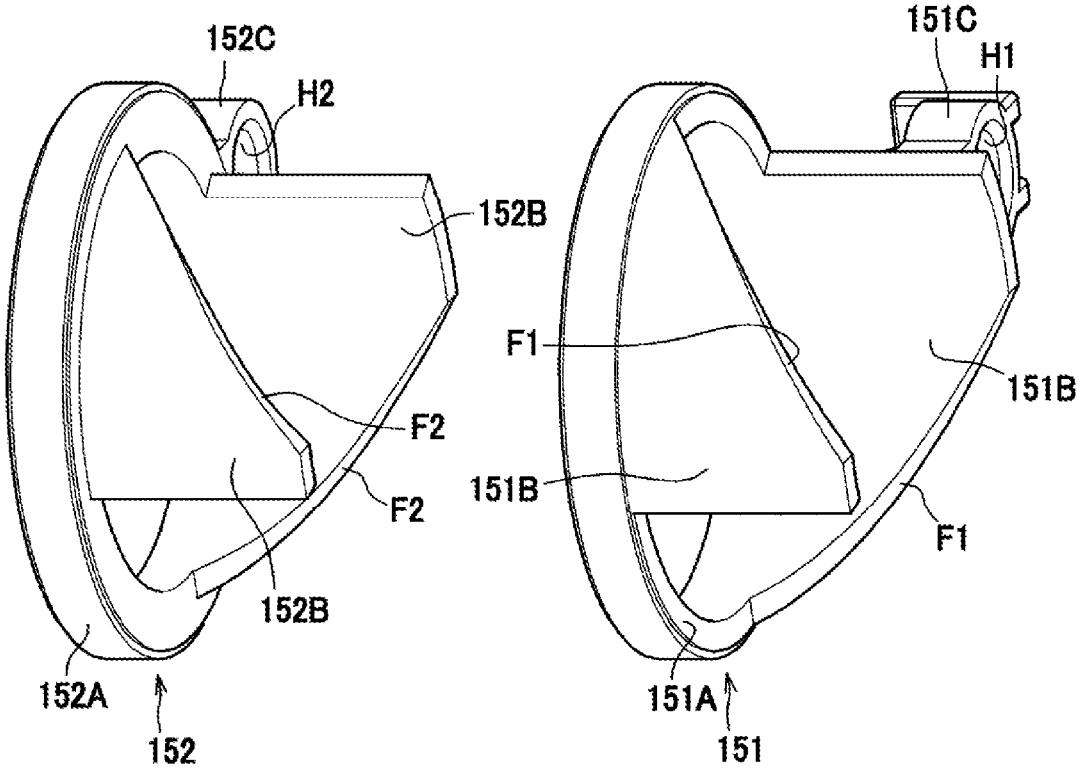
FIG. 7 is a perspective view illustrating a first cam and a second cam.

As shown in FIG. 7, the first cam 151 has two first cam surfaces F1. The first cam surface F1 is a surface of urging the second coupling 120 (refer to FIG. 6) toward the non-engagement position. The first cam 151 is configured to be movable between a first position (a position shown in FIG. 6) at which the second coupling 120 is enabled to be located at the engagement position and a second position (a position shown in FIG. 8) at which the second coupling 120 is enabled to be located at the non-engagement position.

Figure 9:
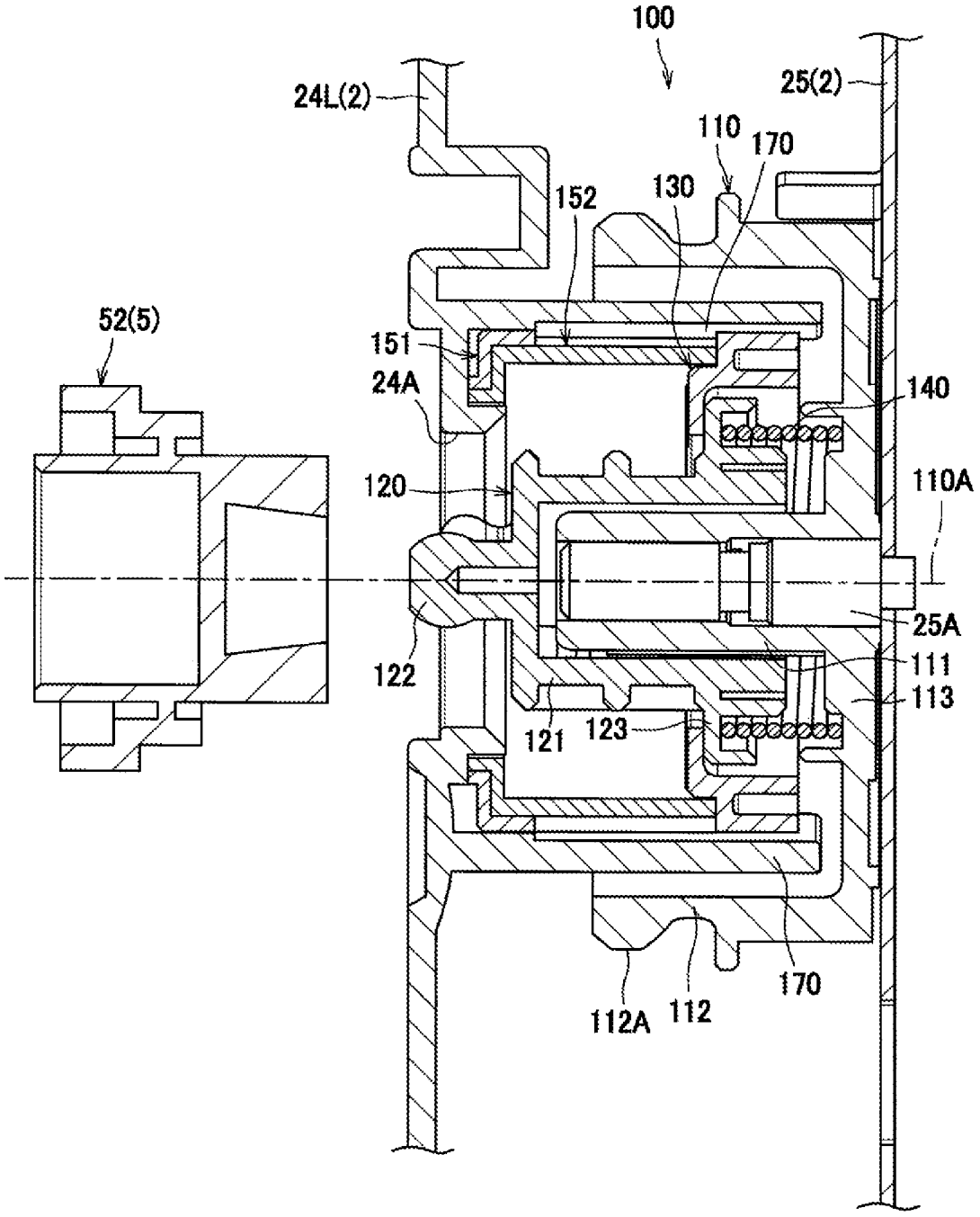
FIG. 9 is a sectional view illustrating a state where the second coupling moves to the non-engagement position by the second cam.

The second cam 152 has two second cam surfaces F2. The second cam surface F2 is a surface of urging the second coupling 120 (refer to FIG. 6) toward the non-engagement position. The second cam 152 is configured to be movable between the first position (a position shown in FIG. 6) at which the second coupling 120 is enabled to be located at the engagement position and the second position (a position shown in FIG. 9) at which the second coupling 120 is enabled to be located at the non-engagement position.

The first cam 151 has a base part 151A, two protrusions 151B, and an extension part 151C. The base part 151A has a ring shape. Each protrusion 151B protrudes from an end face of the base part 151A. Each protrusion 151B has the first cam surface F1. The extension part 151C protrudes from an outer peripheral surface of the protrusion 151B. The extension part 151C has a coupling hole H1.

The second cam 152 has a base part 152A, two protrusions 152B, and an extension part 152C. The base part 152A has a ring shape. Each protrusion 152B protrudes from an end face of the base part 152A. Each protrusion 151B has the second cam surface F2. The extension part 152C protrudes from an outer peripheral surface of the protrusion 152B. The extension part 152C has a coupling hole H2.

Figure 10A:
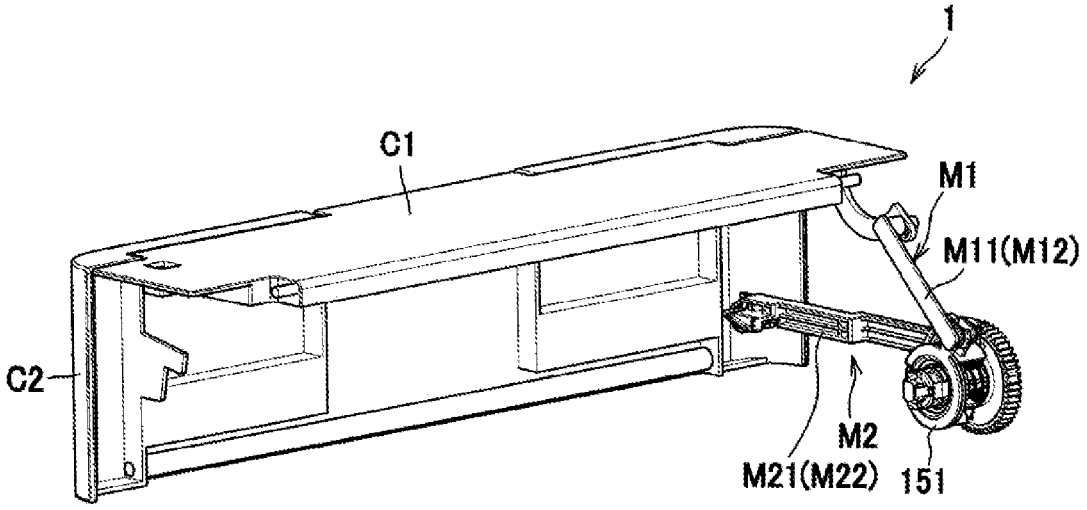
FIG. 10A is a perspective view illustrating a first movement mechanism in a state where the top cover and the front cover are closed.
Figure 10B:
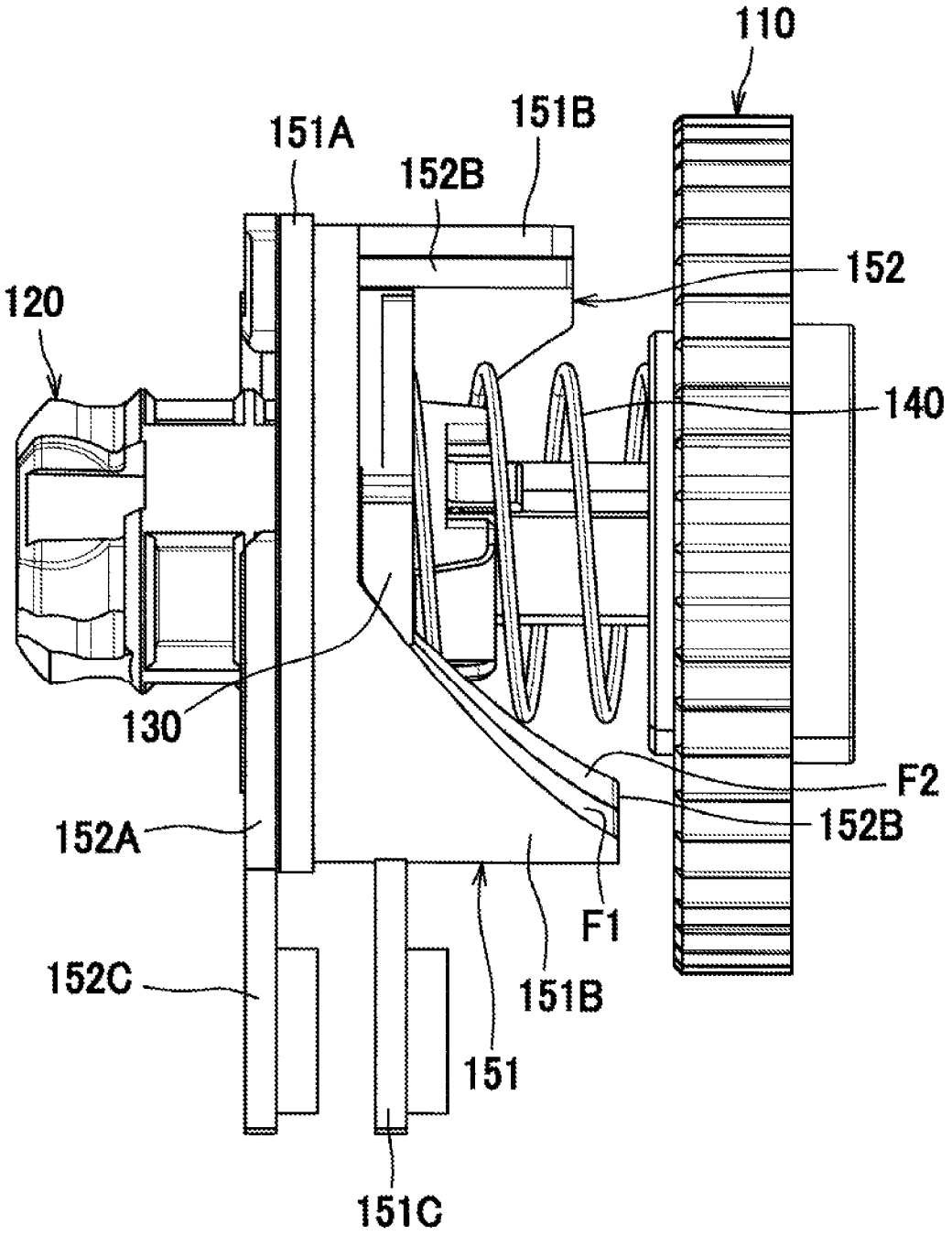
FIG. 10B illustrates a state of the second coupling.

As shown in FIG. 10B, each protrusion 152B of the second cam 152 is arranged at a more inner side than each protrusion 151B of the first cam 151. In a state where the second coupling 120 is located at the non-engagement position, the first cam surface F1 and the second cam surface F2 are flush with each other. Also, the extension part 151C of the first cam 151 and the extension part 152C of the second cam 152 deviate in a moving direction of the second coupling 120.

Figure 11A:
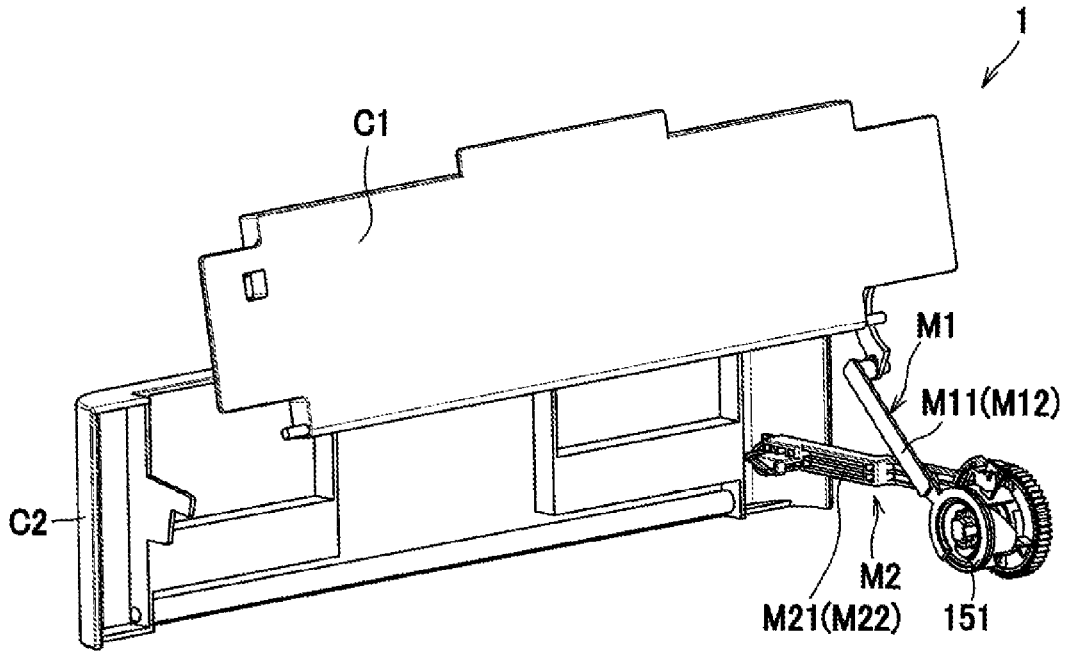
FIG. 11A is a perspective view illustrating the first movement mechanism in a state where only the top cover is opened.
Figure 11B:
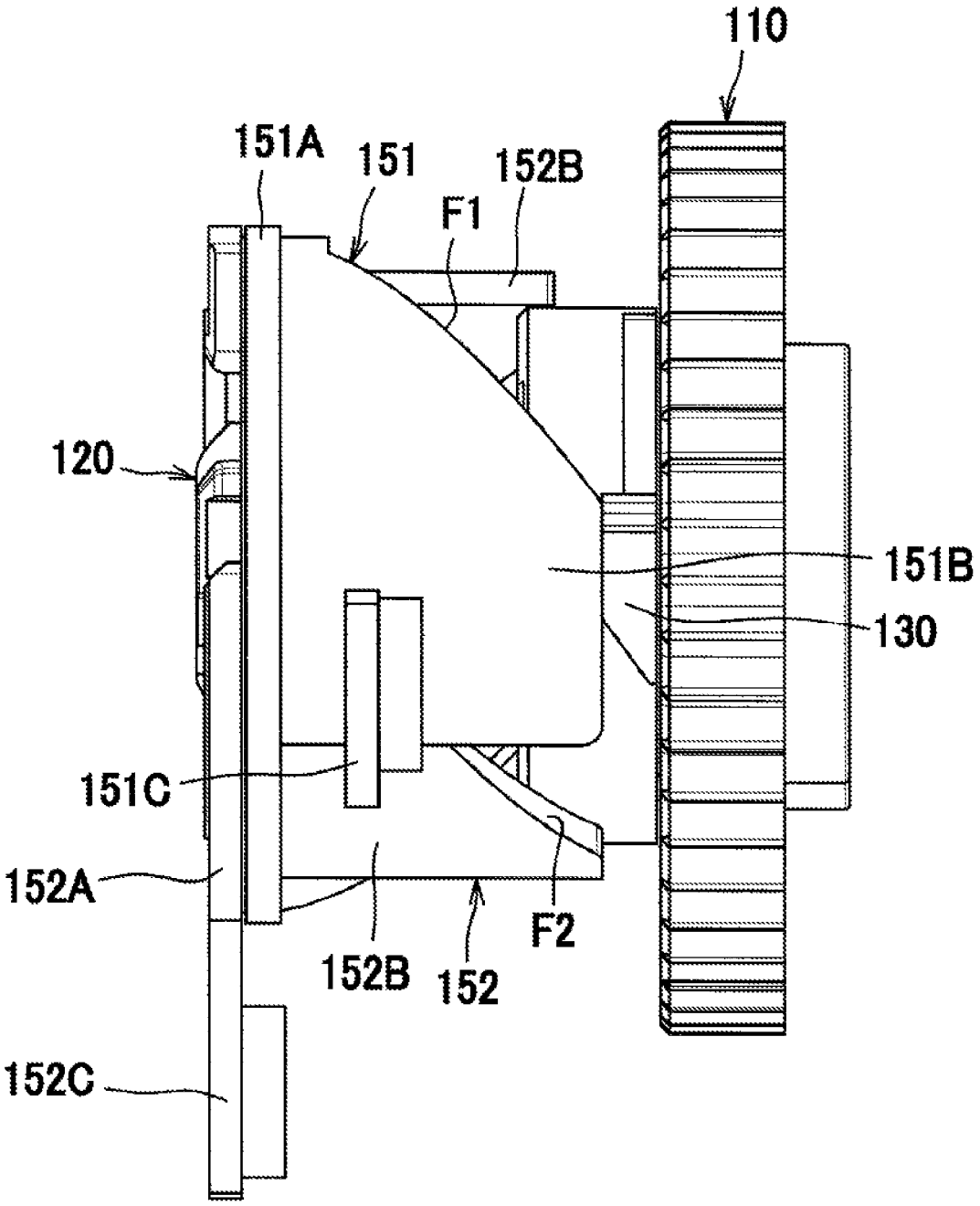
FIG. 11B illustrates a state of the second coupling.
Figure 12A:
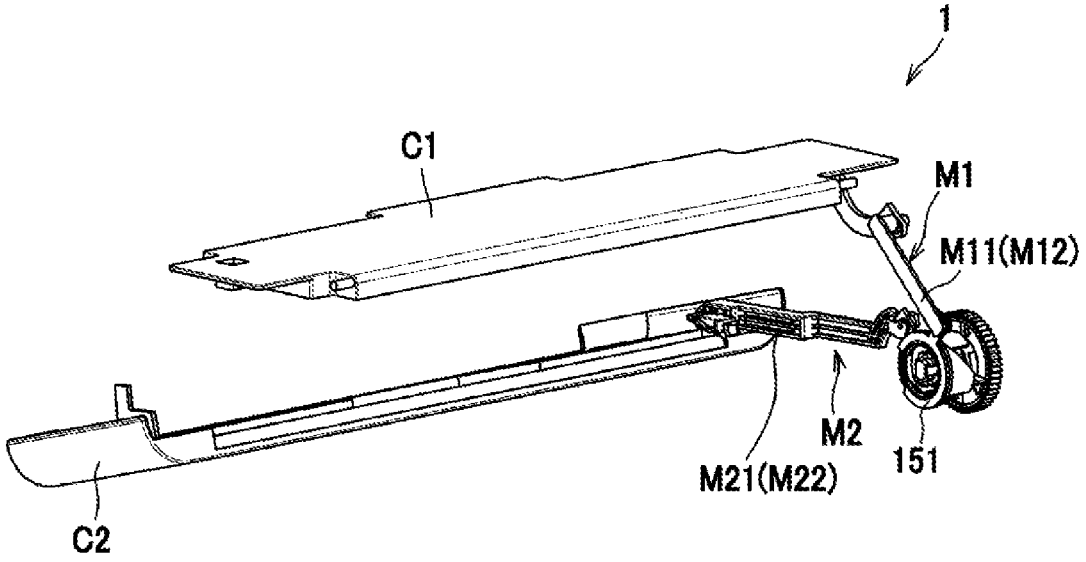
FIG. 12A is a perspective view illustrating the first movement mechanism in a state where only the front cover is opened.
Figure 12B:
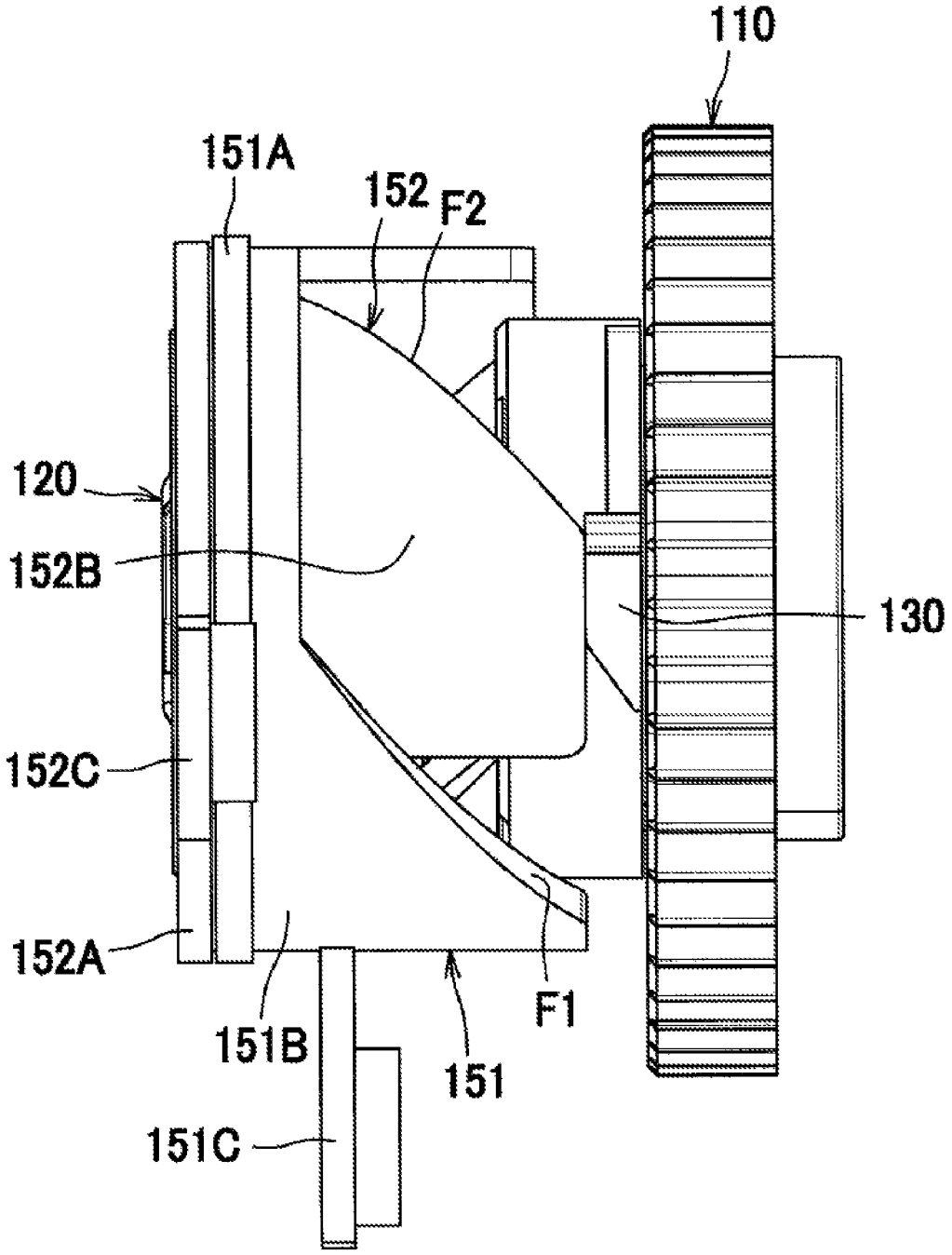
FIG. 12B illustrates a state of the second coupling.

The first cam 151 is configured to be movable even in a state where the second cam 152 is not moving (refer to FIG. 11B). The second cam 152 is configured to be movable even in a state where the first cam 151 is not moving (refer to FIG. 12B). That is, the first cam 151 and the second cam 152 are configured to be independently movable.

As shown in FIG. 10A, the image forming apparatus 1 includes a first movement mechanism M1 and a second movement mechanism M2. The first movement mechanism M1 includes the first cam 151 and a first link mechanism M11. The first link mechanism M11 includes one first link M12. The first link M12 is coupled to the top cover C1 and the first cam 151. Specifically, one end of the first link M12 is coupled to a part of the top cover C1 different from a center of rotation. The other end of the first link M12 is coupled to the coupling hole H1 (refer to FIG. 7) of the first cam 151. As shown in FIGS. 10 and 11, the first movement mechanism M1 is configured to move the second coupling 120 from the engagement position to the non-engagement position, in correspondence to the movement of the top cover C1 from the closed position to the opened position.

The second movement mechanism M2 includes the second cam 152, and a second link mechanism M21. The second link mechanism M21 includes one second link M22. The second link M22 is coupled to the front cover C2 and the second cam 152. Specifically, one end of the second link M22 is coupled to a part of the front cover C2 different from a center of rotation. The other end of the second link M22 is coupled to the coupling hole H2 (refer to FIG. 7) of the second cam 152. As shown in FIGS. 10 and 12, the second movement mechanism M2 is configured to move the second coupling 120 from the engagement position to the non-engagement position, in correspondence to the movement of the front cover C2 from the closed position to the opened position.

Subsequently, operations of the respective movement mechanisms M1, M2 are described with reference to FIGS. 10A to 13B.

As shown in FIGS. 10A, 10B, 11A and 11B, when only the top cover C1 is opened, the first link M12 moves in conjunction with the rotation of the top cover C1. When the first link M12 moves, the first cam 151 rotates from the first position to the second position. When the first cam 151 rotates, the first cam surfaces F1 press the second coupling 120 via the cam contact member 130. Thereby, the second coupling 120 moves from the engagement position to the non-engagement position.

As shown in FIGS. 10A, 10B, 12A and 12B, when only the front cover C2 is opened, the second link M22 moves in conjunction with the rotation of the front cover C2. When the second link M22 moves, the second cam 152 rotates from the first position to the second position. When the second cam 152 rotates, the second cam surfaces F2 press the second coupling 120 via the cam contact member 130. Thereby, the second coupling 120 moves from the engagement position to the non-engagement position.

Figure 13A:
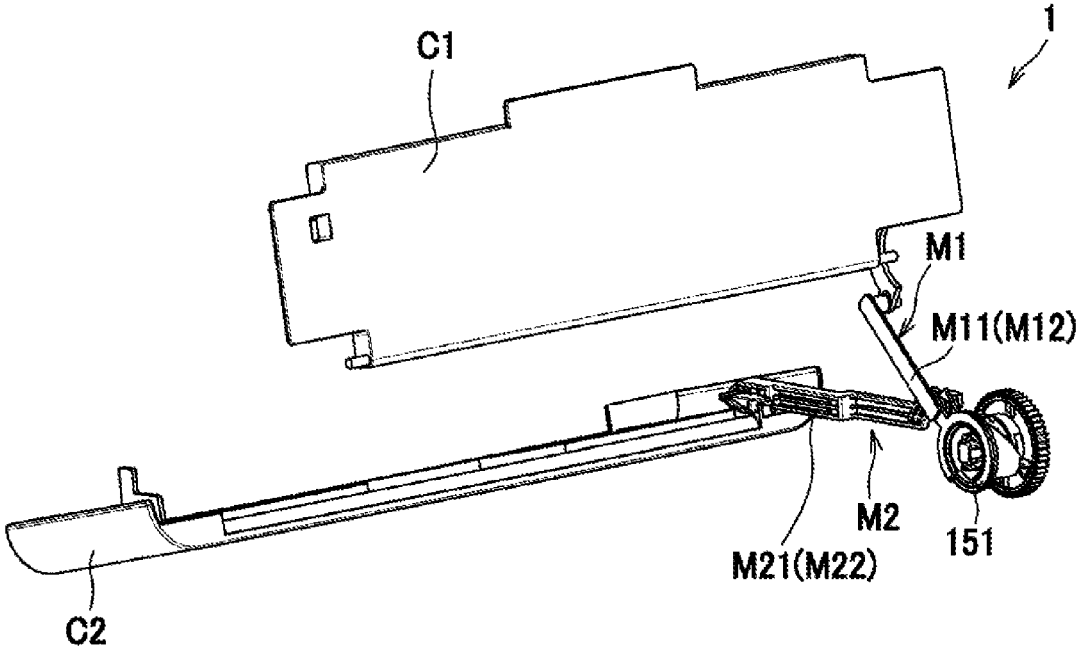
FIG. 13A is a perspective view illustrating the first movement mechanism in a state where the top cover and the front cover are opened.
Figure 13B:
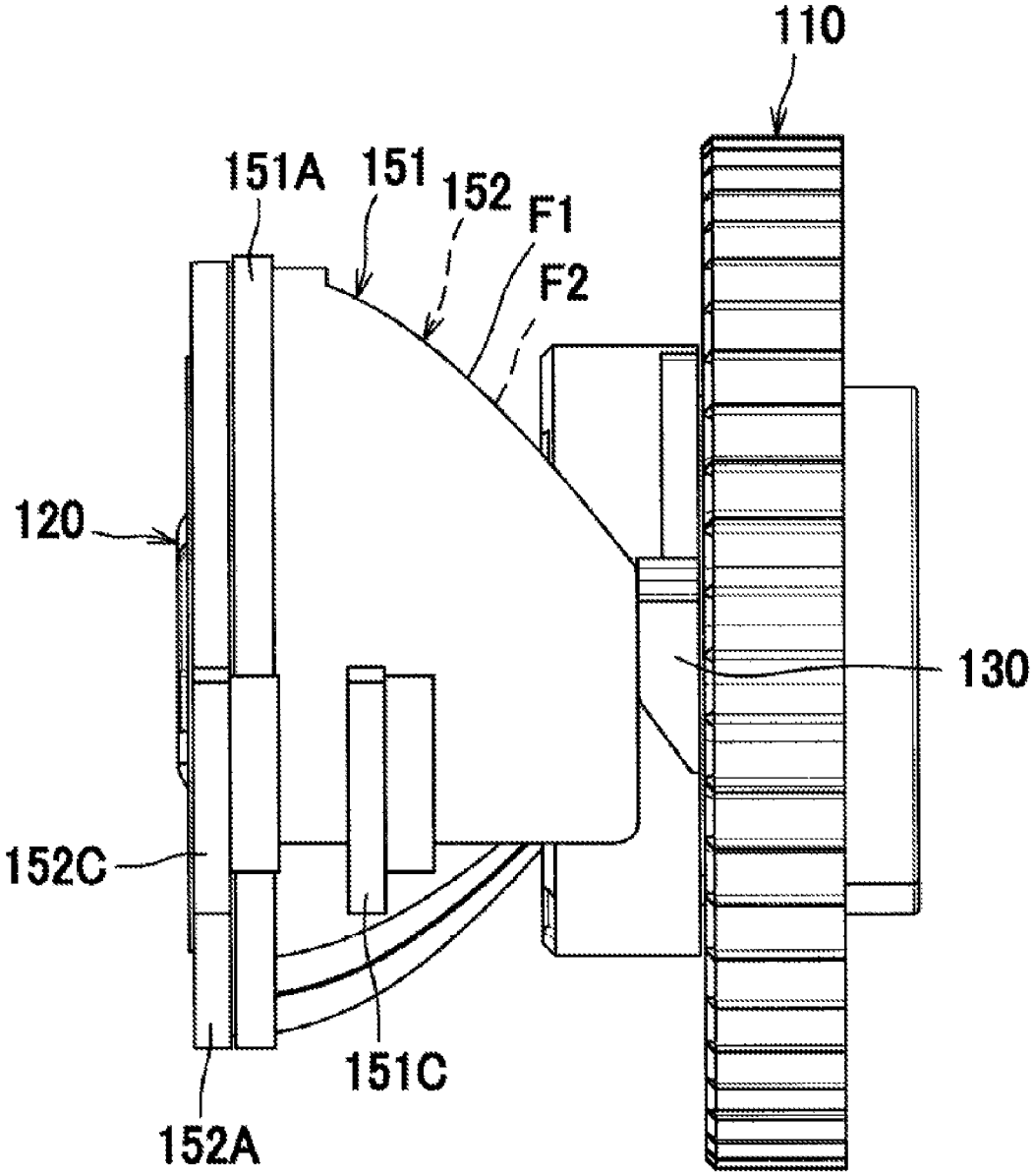
FIG. 13B illustrates a state of the second coupling.

As shown in FIGS. 13A and 13B, when both the top cover C1 and the front cover C2 are opened, the first cam 151 or the second cam 152 presses the second coupling 120 via the cam contact member 130. Thereby, the second coupling 120 moves from the engagement position to the non-engagement position. In the meantime, in a state where both the top cover C1 and the front cover C2 are located at the opened positions, the first cam 151 and the second cam 152 support the second coupling 120 via the cam contact member 130. Thereby, it is possible to favorably receive an urging force of the urging member 140 by the two cams 151, 152.

According to the illustrative embodiment, following advantages can be accomplished.

When only the front cover C2 is opened, it is possible to mount and demount the drum cartridge 8 having the toner cartridge 9 mounted thereto with respect to the housing 2. Also, when only the top cover C1 is opened, it is possible to demount the toner cartridge 9 from the drum cartridge 8. For this reason, when a user intends to mount and demount the drum cartridge 8 having the toner cartridge 9 mounted thereto, the user has only to open only the front cover C2. Also, when the user intends to demount only the toner cartridge 9, the user has only to demount only the top cover C1. As a result, since the user has only to open only the cover corresponding to the cartridge that the user intends to replace, it is possible to suppress the cartridge to be replaced from being mistaken, and to easily replace the toner cartridge 9 and the drum cartridge 8.

When both the front cover C2 and the top cover C1 covering the common opening 23 are opened, it is possible to mount and demount the drum cartridge 8 while widely using the opening 23. For this reason, it is possible to easily replace the drum cartridge 8.

Since the first cam 151 and the second cam 152 can independently move, when any one of the first cam 151 and the second cam 152 moves, it is possible to move the second coupling 120 to the non-engagement position.

Although the illustrative embodiment of the present disclosure has been described, the present disclosure is not limited to the illustrative embodiment. The specific configuration can be appropriately changed without departing from the gist of the present disclosure.

In the illustrative embodiment, the second coupling 120 (the cam contact member 130) moves by the two cams 151, 152. However, the present disclosure is not limited thereto. For example, as shown in FIG. 14, the cam contact member 130 may be moved by only one first cam 151.

Figure 14:
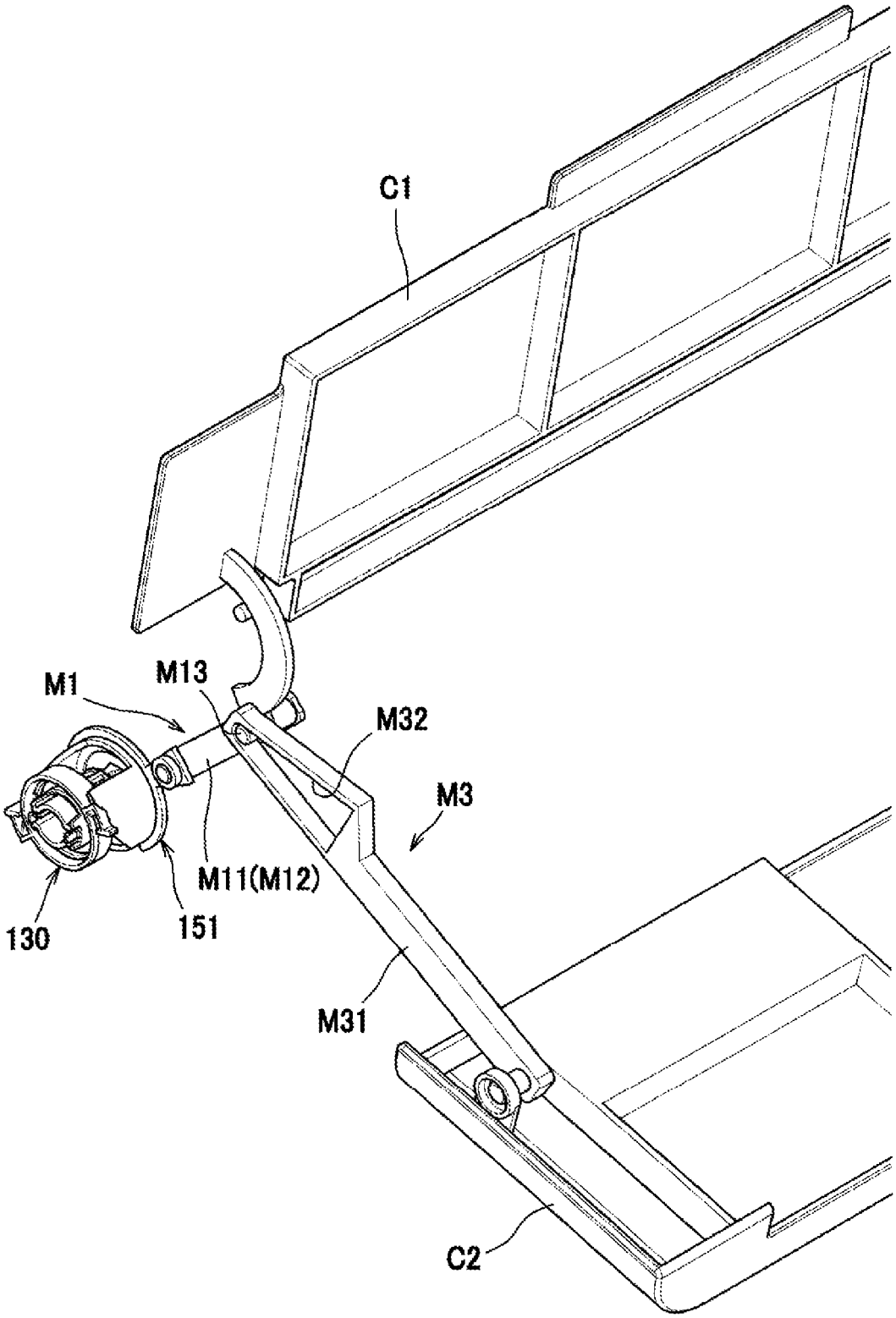
FIG. 14 is a perspective view illustrating a third movement mechanism.

Specifically, in the embodiment shown in FIG. 14, the first movement mechanism M1 similar to the illustrative embodiment is provided. Also, in the embodiment, a third link mechanism M3 is provided. The third link mechanism M3 is a mechanism configured to move the top cover C1 from the closed position to the opened position, in correspondence to the movement of the front cover C2 from the closed position to the opened position. The third link mechanism M3 has one third link M31. The third link M31 has one end portion coupled to the front cover C2 and the other end portion coupled to the first link M12 of the first link mechanism M11.

Specifically, one end portion of the third link M31 is coupled to a part of the front cover C2 different from the center of rotation. The other end portion of the third link M31 has a long hole M32. The long hole M32 has a triangular shape. The first link M12 of the first link mechanism M11 has a protrusion M13. The protrusion M13 engages with the long hole M32.

Figure 15A:
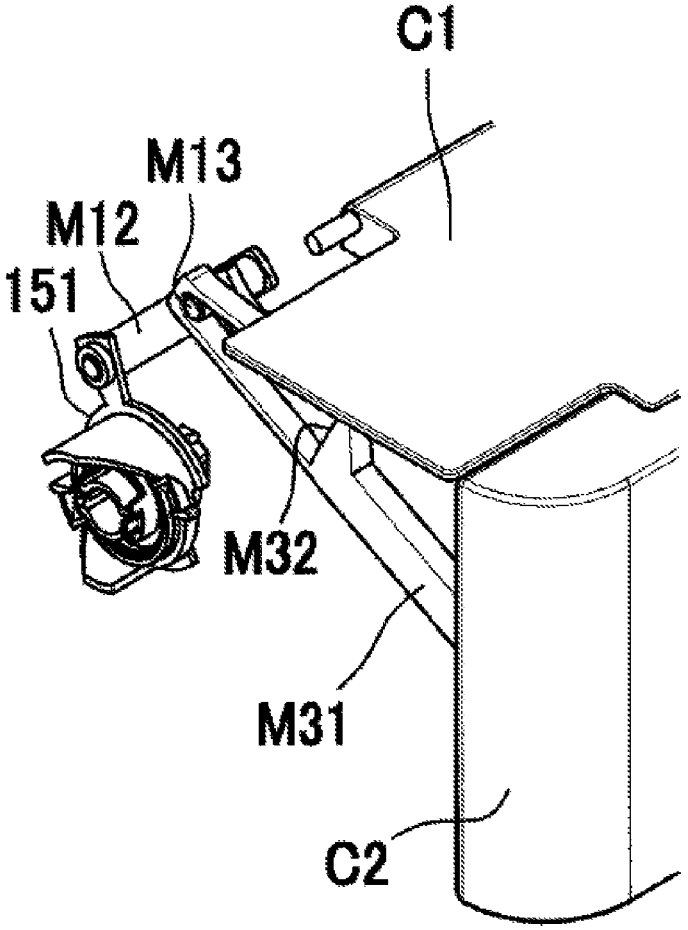
FIG. 15A illustrates operations of the third movement mechanism in a state where the top cover and the front cover are closed.

As shown in FIG. 15A, when the top cover C1 is located at the closed position and the front cover C2 is located at the closed position, the protrusion M13 is located at one end of the long hole M32. Specifically, the protrusion M13 is located at one corner of the triangular long hole M32.

Figure 15B:
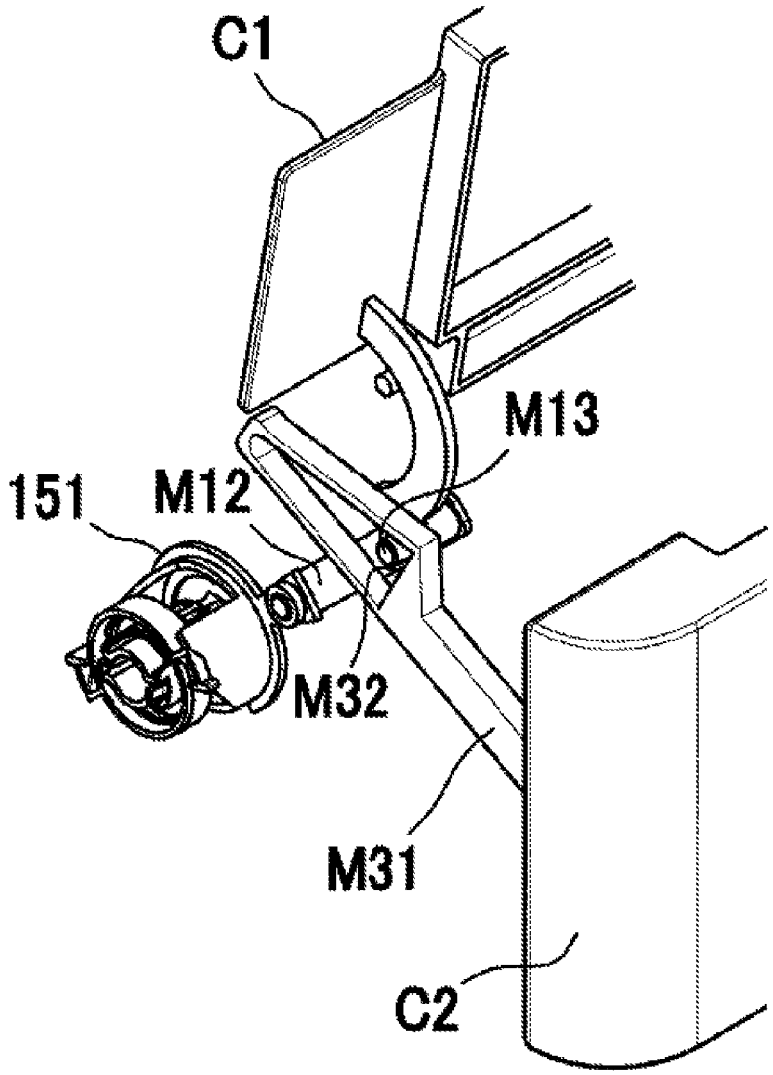
FIG. 15B illustrates operations of the third movement mechanism in a state where only the top cover is opened.
Figure 15C:
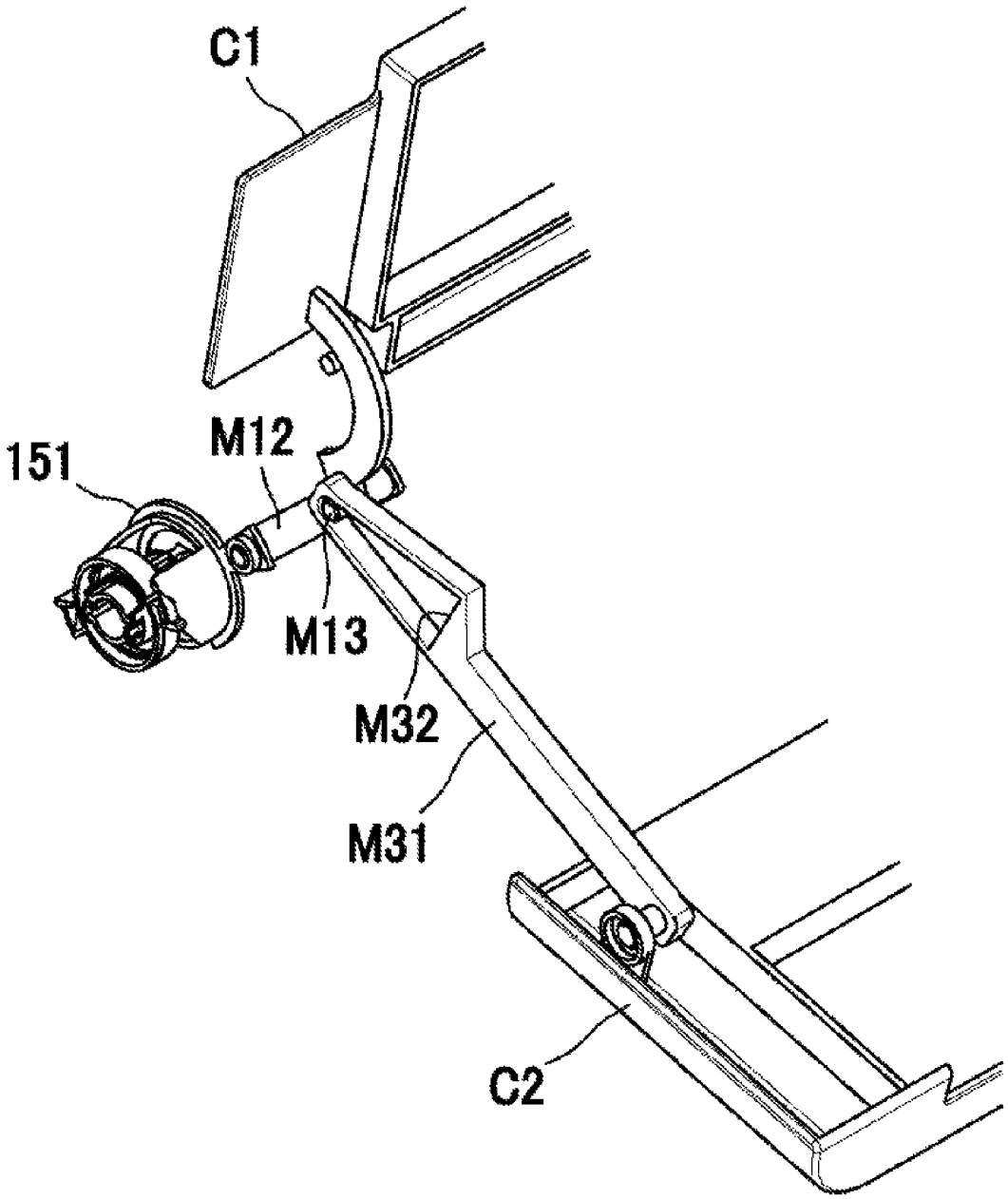
FIG. 15C illustrates operations of the third movement mechanism in a state where the front cover is opened.

As shown in FIG. 15B, when the front cover C2 is located at the closed position and the top cover C1 is located at the opened position, the protrusion M13 is located at the other end of the long hole M32. Specifically, when moving the top cover C1 from the closed position to the opened position, the protrusion M13 is movable in the long hole M32 without interfering with the third link M31.

When only the front cover C2 is opened from the state shown in FIG. 15A, the third link M31 moves in conjunction with the rotation of the front cover C2. Thereby, the protrusion M13 engaged with the long hole M32 of the third link M31 also moves together with the third link M31. For this reason, since the first link M12 moves, the top cover C1 also moves from the closed position to the opened position. In the meantime, at this time, the first cam 151 also moves from the first position to the second position. Therefore, according to opening the front cover C2, the second coupling 120 is allowed to move to the non-engagement position.

Figure 16A:
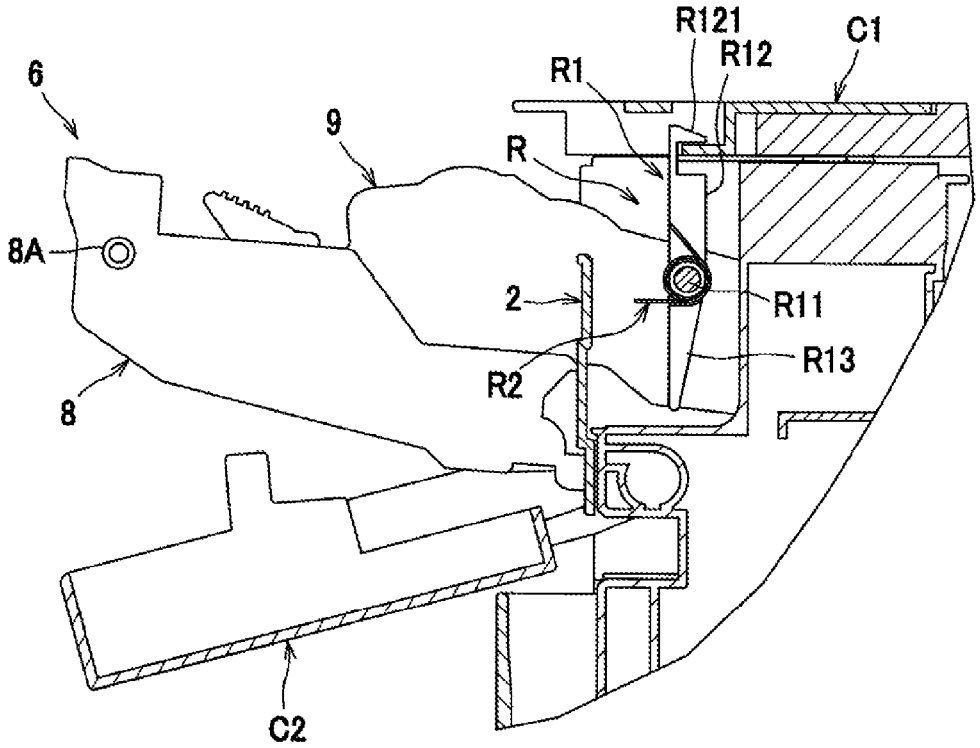
FIG. 16A is a sectional view illustrating a lock mechanism of another form in a locked state.
Figure 16B:
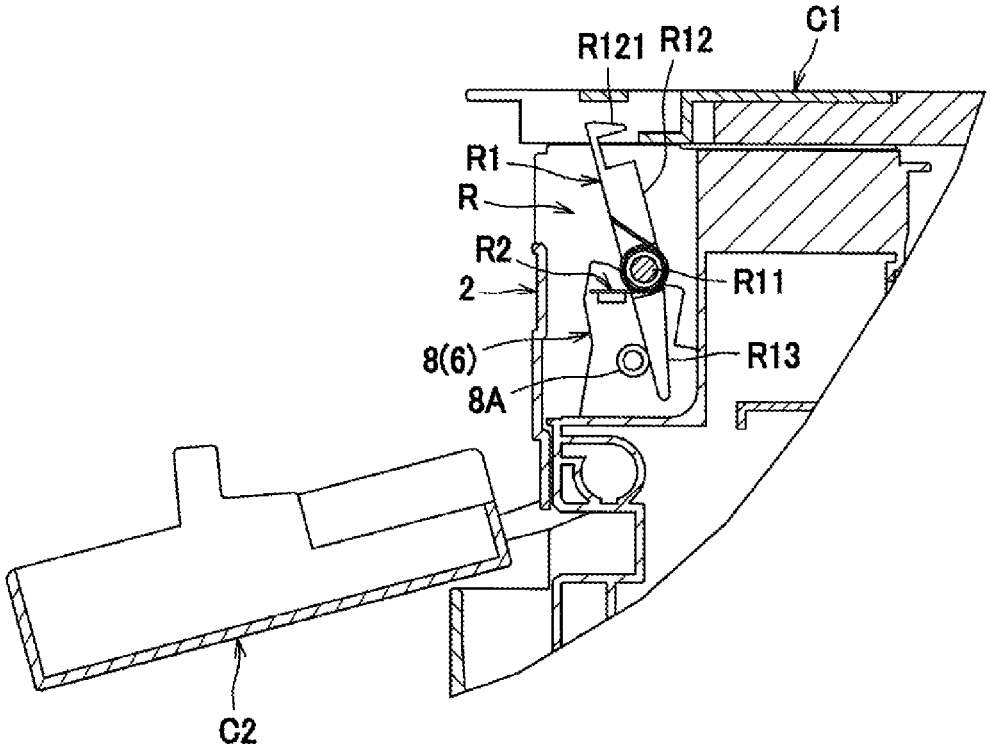
FIG. 16B is a sectional view illustrating a lock mechanism of another form in a non-locked state.

As shown in FIGS. 16A and 16B, the image forming apparatus 1 may include a lock mechanism R. The lock mechanism R is a mechanism for locking the top cover C1 at the closed position. The lock mechanism R includes a lock member R1 and a torsion spring R2.

The lock member R1 has a shaft part R11, a first arm R12, and a second arm R13. The shaft part R11 is rotatably supported to the housing 2. The first arm R12 extends from the shaft part R11 in a radial direction of the shaft part R11. The first arm R12 has an engagement part R121. The engagement part R121 engages with the top cover C1.

The second arm R13 extends from the shaft part R11 toward an opposite side to the first arm R12. The drum cartridge 8 has a protrusion 8A. The second arm R13 can be engaged with the protrusion 8A.

The lock member R1 is configured to be rotatable between a locked position (a position shown in FIG. 16A) at which it engages with the top cover C1 and a non-locked position (a position shown in FIG. 16B) at which it is disengages from the top cover C1. The torsion spring R2 is configured to urge the lock member R1 toward the locked position.

In the embodiment, as shown in order of FIGS. 16A and 16B, while mounting the process cartridge 6 to the housing 2, the protrusion 8A of the drum cartridge 8 presses the second arm R13 of the lock member R1. Thereby, in the state where the process cartridge 6 is mounted to the housing 2, the lock member R1 is located at the non-locked position. For this reason, in the state where the process cartridge 6 is mounted to the housing 2, the top cover C1 can be opened and closed.

Also, as shown in order of FIGS. 16B and 16A, while demounting the process cartridge 6 from the housing 2, the protrusion 8A of the drum cartridge 8 is disengages from the second arm R13 of the lock member R1. Thereby, the lock member R1 rotates from the non-locked position to the locked position by the urging force of the torsion spring R2. For this reason, in the state where the process cartridge 6 is demounted from the housing 2, the top cover C1 is locked to the closed position by the lock mechanism R. That is, when the drum cartridge 8 is demounted from the housing 2 in the state where the top cover C1 is located at the closed position, the lock mechanism R locks the top cover C1 to the closed position.

In the illustrative embodiment, each of the link mechanisms M11, M21, M3 has one link. However, the present disclosure is not limited thereto. For example, each link mechanism may have two or more links.

In the respective illustrative embodiments, the laser printer has been exemplified as the image forming apparatus. However, the present disclosure is not limited thereto and may be applied to the other image forming apparatus. For example, the image forming apparatus may be configured to perform the exposure by an LED and may be a copier or a complex machine.

The toner cartridge 9 of the illustrative embodiment has the developing roller 91. However, the present disclosure can be applied to a toner cartridge with no developing roller, too. In the meantime, in this case, the developing roller may be provided to the drum cartridge.

The respective elements of the illustrative embodiments and modified embodiments can be implemented with being arbitrarily combined.

According to the present disclosure, there is provided an image forming apparatus including: a housing having an opening; a top cover configured to cover a part of the opening and movable between a closed position at which a part of the opening is covered and an opened position at which a part of the opening is opened; a front cover configured to cover a part of the remaining of the opening and movable between a closed position at which a part of the remaining of the opening is covered and an opened position at which a part of the remaining of the opening is opened; a toner cartridge having a case configured to accommodate therein toner, and a drum cartridge including a photosensitive drum and receives the toner cartridge to be mountable thereto. In a state where the front cover is located at the opened position, the drum cartridge having the toner cartridge mounted thereto is mountable and demountable to and from the housing through at least a part of the remaining of the opening. In a state where the front cover is located at the closed position, the drum cartridge having the toner cartridge mounted thereto is prevented from being mounted and demounted to and from the housing through a part of the opening or a part of the remaining of the opening. In a state where the top cover is located at the opened position, the toner cartridge is mountable and demountable to and from the drum cartridge through a part of the opening, in a state where the drum cartridge is mounted to the housing. In a state where the top cover is located at the closed position, the toner cartridge is prevented from being demounted from the drum cartridge through a part of the opening, in the state where the drum cartridge is mounted to the housing.

According to the above configuration, in a state where only the front cover is opened, it is possible to mount and demount the drum cartridge to and from the housing, with the toner cartridge being mounted to the drum cartridge. Also, in a state where only the top cover is opened, it is possible to demount the toner cartridge from the drum cartridge. For this reason, when the user intends to mount and demount the drum cartridge having the toner cartridge mounted thereto, the user has only to open only the front cover. Also, when the user intends to demount only the toner cartridge, the user has only to open only the top cover. As a result, since the user has only to open only the cover corresponding to the cartridge that the user intends to replace, it is possible to suppress the cartridge to be replaced from being mistaken, and to easily replace the toner cartridge and the drum cartridge.

The image forming apparatus may be configured as such that, in a state where the front cover is located at the opened position and the top cover is located at the opened position, the drum cartridge is mountable and demountable to and from the housing through the opening.

According to the above configuration, in a state where both the front cover and the top cover covering the common opening are opened, it is possible to mount and demount the drum cartridge while widely using the opening. For this reason, it is possible to easily replace the drum cartridge.

The image forming apparatus may be configured as such that, the top cover is arranged at an upper surface of the image forming apparatus, and the front cover is arranged at a front surface of the image forming apparatus.

The image forming apparatus may be configured as such that, the toner cartridge includes a developing roller.

The image forming apparatus may be configured as such that, the toner cartridge includes a first coupling configured to receive a drive force of driving the developing roller, and the image forming apparatus further includes: a second coupling movable between an engagement position at which the second coupling engages with the first coupling and drives the first coupling and a non-engagement position at which the engagement with the first coupling is released, and a first movement mechanism configured to move the second coupling from the engagement position to the non-engagement position in correspondence to movement of the top cover from the closed position to the opened position.

The image forming apparatus may be configured as such that, the first movement mechanism includes: a first cam having a first cam surface for urging the second coupling toward the non-engagement position and being movable between a first position at which the second coupling is enabled to be located at the engagement position and a second position at which the second coupling is enabled to be located at the non-engagement position, and a first link mechanism having at least one link and coupled to the top cover and the first cam.

The image forming apparatus may further include: a second movement mechanism configured to move the second coupling from the engagement position to the non-engagement position, in correspondence to movement of the front cover from the closed position to the opened position.

The second movement mechanism may include: a second cam having a second cam surface for urging the second coupling toward the non-engagement position and being movable between the first position at which the second coupling is enabled to be located at the engagement position and the second position at which the second coupling is enabled to be located at the non-engagement position, and a second link mechanism having at least one link and coupled to the front cover and the second cam.

The image forming apparatus may be configured as such that, the first cam is movable in a state where the second cam is not moving, and the second cam is movable in a state where the first cam is not moving.

According to the above configurations, since the first cam and the second cam can independently move, when any one of the first cam and the second cam moves, it is possible to move the second coupling to the non-engagement position.

The image forming apparatus may further include: a third movement mechanism having an urging member configured to move the second coupling from the non-engagement position toward the engagement position.

The image forming apparatus may further include: a third link mechanism configured to move the top cover from the closed position to the opened position in correspondence to movement of the front cover from the closed position to the opened position, wherein the third link mechanism has at least one link, and one end portion thereof is coupled to the front cover and the other end portion is coupled to the first link mechanism.

The image forming apparatus may further include: a lock mechanism configured to lock the top cover to the closed position when the drum cartridge is demounted from the housing in a state where the top cover is located at the closed position.

According to the present disclosure, it is possible to provide the image forming apparatus from which the toner cartridge and the drum cartridge can be easily replaced.

What is claimed is:

1. An image forming apparatus comprising:

a housing having an opening;

a top cover configured to cover a part of the opening and movable between a closed position at which a part of the opening is covered and an opened position at which a part of the opening is opened;

a front cover configured to cover a part of the remaining of the opening and movable between a closed position at which a part of the remaining of the opening is covered and an opened position at which a part of the remaining of the opening is opened;

a toner cartridge having a case configured to accommodate therein toner;

a drum cartridge including a photosensitive drum and receiving the toner cartridge to be mountable thereto; and a lock mechanism configured to lock the top cover to the closed position when the drum cartridge is demounted from the housing in a state where the top cover is located at the closed position, wherein in a state where the front cover is located at the opened position, the drum cartridge having the toner cartridge mounted thereto is mountable and demountable to and from the housing through at least a part of the remaining of the opening, wherein in a state where the front cover is located at the closed position, the drum cartridge having the toner cartridge mounted thereto is prevented from being mounted and demounted to and from the housing through a part of the opening or a part of the remaining of the opening, wherein in a state where the top cover is located at the opened position, the toner cartridge is mountable and demountable to and from the drum cartridge through a part of the opening, in a state where the drum cartridge is mounted to the housing, and wherein in a state where the top cover is located at the closed position, the toner cartridge is prevented from being demounted from the drum cartridge through a part of the opening, in the state where the drum cartridge is mounted to the housing.

2. The image forming apparatus according to claim 1, wherein in a state where the front cover is located at the opened position and the top cover is located at the opened position, the drum cartridge is mountable and demountable to and from the housing through the opening.

3. The image forming apparatus according to claim 1, wherein the top cover is arranged at an upper surface of the image forming apparatus, and wherein the front cover is arranged at a front surface of the image forming apparatus.

4. The image forming apparatus according claim 1, wherein the toner cartridge includes a developing roller.

5. The image forming apparatus according to claim 4, wherein the toner cartridge includes a first coupling configured to receive a drive force of driving the developing roller, and wherein the image forming apparatus further comprises:

a second coupling movable between an engagement position at which the second coupling engages with the first coupling and drives the first coupling and a non-engagement position at which the engagement with the first coupling is released, and a first movement mechanism configured to move the second coupling from the engagement position to the non-engagement position in correspondence to movement of the top cover from the closed position to the opened position.

6. The image forming apparatus according to claim 5, wherein the first movement mechanism includes:

a first cam having a first cam surface for urging the second coupling toward the non-engagement position and being movable between a first position at which the second coupling is enabled to be located at the engagement position and a second position at which the second coupling is enabled to be located at the non-engagement position, and a first link mechanism having at least one link and coupled to the top cover and the first cam.

7. The image forming apparatus according to claim 6 further comprising:

a second movement mechanism configured to move the second coupling from the engagement position to the non-engagement position, in correspondence to movement of the front cover from the closed position to the opened position.

8. The image forming apparatus according to claim 7, wherein the second movement mechanism includes:

a second cam having a second cam surface for urging the second coupling toward the non-engagement position and being movable between the first position at which the second coupling is enabled to be located at the engagement position and the second position at which the second coupling is enabled to be located at the non-engagement position, and a second link mechanism having at least one link and coupled to the front cover and the second cam.

9. The image forming apparatus according to claim 8, wherein the first cam is movable in a state where the second cam is not moving, and wherein the second cam is movable in a state where the first cam is not moving.

10. The image forming apparatus according to claim 6 further comprising:

a third movement mechanism having an urging member configured to move the second coupling from the non-engagement position toward the engagement position.

11. The image forming apparatus according to claim 6 further comprising:

a third link mechanism configured to move the top cover from the closed position to the opened position in correspondence to movement of the front cover from the closed position to the opened position, wherein the third link mechanism has at least one link, and one end portion thereof is coupled to the front cover and the other end portion is coupled to the first link mechanism.

12. An image forming apparatus comprising:

a housing having an opening;

a top cover configured to cover a part of the opening and movable between a closed position at which a part of the opening is covered and an opened position at which a part of the opening is opened;

a front cover configured to cover a part of the remaining of the opening and movable between a closed position at which a part of the remaining of the opening is covered and an opened position at which a part of the remaining of the opening is opened;

a toner cartridge having a case configured to accommodate therein toner, the toner cartridge including a developing roller and a first coupling configured to receive a drive force of driving the developing roller;

a second coupling movable between an engagement position at which the second coupling engages with the first coupling and drives the first coupling and a non-engagement position at which the engagement with the first coupling is released;

a first movement mechanism configured to move the second coupling from the engagement position to the non-engagement position in correspondence to movement of the top cover from the closed position to the opened position; and a drum cartridge including a photosensitive drum and receiving the toner cartridge to be mountable thereto, wherein in a state where the front cover is located at the opened position, the drum cartridge having the toner cartridge mounted thereto is mountable and demountable to and from the housing through at least a part of the remaining of the opening, wherein in a state where the front cover is located at the closed position, the drum cartridge having the toner cartridge mounted thereto is prevented from being mounted and demounted to and from the housing through a part of the opening or a part of the remaining of the opening, wherein in a state where the top cover is located at the opened position, the toner cartridge is mountable and demountable to and from the drum cartridge through a part of the opening, in a state where the drum cartridge is mounted to the housing, and wherein in a state where the top cover is located at the closed position, the toner cartridge is prevented from being demounted from the drum cartridge through a part of the opening, in the state where the drum cartridge is mounted to the housing.

13. The image forming apparatus according to claim 12, wherein the first movement mechanism includes:

a first cam having a first cam surface for urging the second coupling toward the non-engagement position and being movable between a first position at which the second coupling is enabled to be located at the engagement position and a second position at which the second coupling is enabled to be located at the non-engagement position, and a first link mechanism having at least one link and coupled to the top cover and the first cam.

14. The image forming apparatus according to claim 13 further comprising:

a second movement mechanism configured to move the second coupling from the engagement position to the non-engagement position, in correspondence to movement of the front cover from the closed position to the opened position.

15. The image forming apparatus according to claim 14, wherein the second movement mechanism includes:

a second cam having a second cam surface for urging the second coupling toward the non-engagement position and being movable between the first position at which the second coupling is enabled to be located at the engagement position and the second position at which the second coupling is enabled to be located at the non-engagement position, and a second link mechanism having at least one link and coupled to the front cover and the second cam.

16. The image forming apparatus according to claim 15, wherein the first cam is movable in a state where the second cam is not moving, and wherein the second cam is movable in a state where the first cam is not moving.

17. The image forming apparatus according to claim 13 further comprising:

a third movement mechanism having an urging member configured to move the second coupling from the non-engagement position toward the engagement position.

18. The image forming apparatus according to claim 13 further comprising:

a third link mechanism configured to move the top cover from the closed position to the opened position in correspondence to movement of the front cover from the closed position to the opened position, wherein the third link mechanism has at least one link, and one end portion thereof is coupled to the front cover and the other end portion is coupled to the first link mechanism.

19. The image forming apparatus according to claim 12 further comprising:

a lock mechanism configured to lock the top cover to the closed position when the drum cartridge is demounted from the housing in a state where the top cover is located at the closed position.

* * * * *